United States Patent [19]

Ito

[11] Patent Number: 5,065,181

[45] Date of Patent: Nov. 12, 1991

[54] IMAGE FORMING APPARATUS CAPABLE OF INSCRIBING A DESIRED DATE ON COPYING PAPER

[75] Inventor: Masazumi Ito, Osaka, Japan

[73] Assignee: Minolta Camera Kabushiki Kaisha, Osaka, Japan

[21] Appl. No.: 452,801

[22] Filed: Dec. 18, 1989

[30] Foreign Application Priority Data

Dec. 21, 1988 [JP] Japan ..... 63-322804

[51] Int. Cl.[5] ..... G03G 15/00; G03G 15/04

[52] U.S. Cl. ..... 355/202; 355/244; 355/40

[58] Field of Search ..... 355/202, 39–41, 355/218, 75, 244; 354/105

[56] References Cited

U.S. PATENT DOCUMENTS 4,640,601 2/1987 Deguchi et al. ..... 355/218

4,701,044 10/1987 Horiuchi et al. ..... 355/218

*Primary Examiner*—Joan H. Pendegrass

*Attorney, Agent, or Firm*—Willian, Brinks, Olds, Hofer, Gilson & Lione

[57] ABSTRACT

An image forming apparatus is disclosed which is capable of forming additionally on a copying paper data of date other than image information recorded on a given document. This apparatus incorporates therein a calendar for memorizing the current date and allows the memorized date to be stored in a memory. The data stored in the memory is advanced or set back by the unit of one day. The date changed from the real date is formed on the copying paper in addition to the image informataion recorded on the document. Owing to this function of the apparatus, the data of future or past can be formed additionally on the copying paper. The operation for the change of date is executed by the input through a console.

12 Claims, 28 Drawing Sheets

FIG.10B
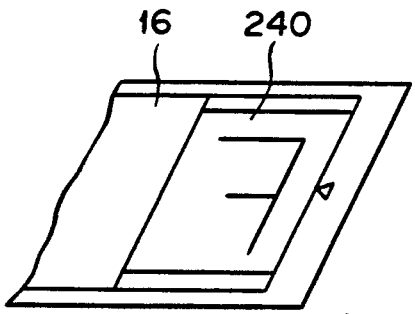
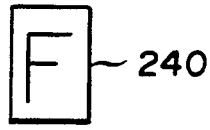
FIG.10A
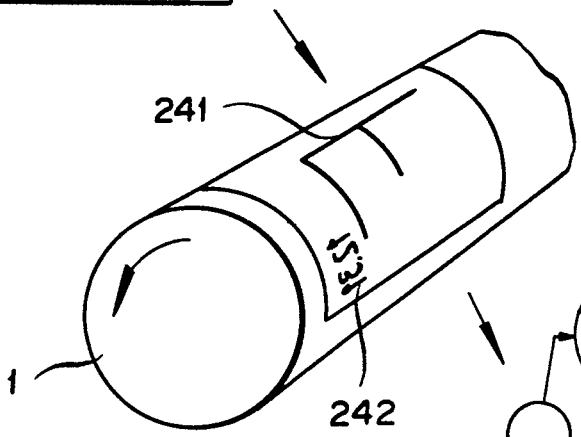
FIG.10C
FIG.10E
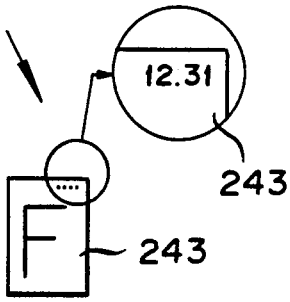
FIG.10D
FIG.13
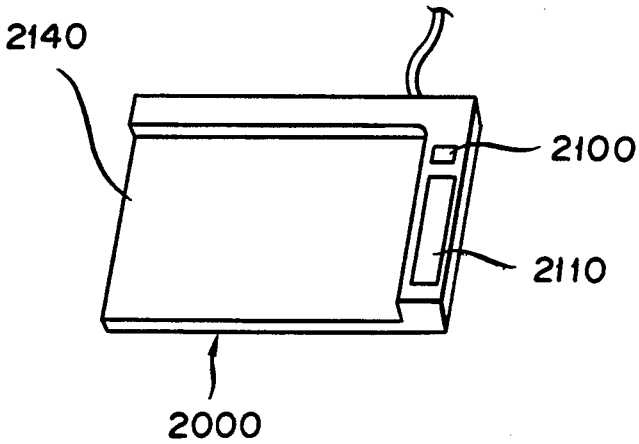

| COORDINATES NUMBER | HEAD STROKE |
|---|---|
| 1 ≦ W ≦ 12 | 0mm |
| 13 ≦ W ≦ 24 | 40mm |
| 25 ≦ W ≦ 36 | 80mm |
| 37 ≦ W ≦ 48 | 120mm |
| 49 ≦ W ≦ 60 | 160mm |
| 61 ≦ W ≦ 72 | 200mm |
| 73 ≦ W ≦ 84 | 240mm |
| 85 ≦ W ≦ 96 | 280mm |

IMAGE FORMING APPARATUS CAPABLE OF INSCRIBING A DESIRED DATE ON COPYING PAPER

BACKGROUND OF THE INVENTION

1. Field of the Invention

This invention relates to an image forming apparatus possessing an ability to inscribe a date and more particularly to an image forming apparatus adapted to permit changes in the date to be inscribed.

2. Description of the Prior Art

The image forming apparatus such as a copying machine or a printer using the electrophotographic process is provided with a photosensitive drum and, therefore, is allowed to form an electrostatic latent image on the surface of the drum by electrically charging the drum and exposing the charged drum to the light corresponding to the information of image on a given document, convert the electrostatic latent image into a toner image, i.e. a visible image, by deposition of toner particles thereon, and transfer this toner image onto a copying paper.

The image forming apparatuses of this kind are extensively utilized for copying information in virtually every field of the industry. The apparatus possessing an ability to inscribe such additive image data as date and page number on a copying paper in addition to an ability to reproduce the image of a given document has been developed.

It is when the date on which the reproduction of an image on a given document is actually used in the reproduction of a given image is desired to be preserved for subsequent reference that the data of the date is additionally inscribed on the copying paper by the use of the image forming apparatus endowed with this ability. Generally, the date to be recorded on a reproduced copy, when the reproduced copy happens to contain data for a meeting, is that on which the meeting is to be actually held. Not infrequently, this date differs from the date on which the reproduced copy is produced, namely the copying paper is actually used for the reproduction of the data.

The inscription of the data of a date has been heretofore effected by reading the date to be inscribed on a clock IC incorporated in the image forming apparatus and, on the basis of the data of the read date, driving a device for executing the inscription such as, for example, a LED array head composed of a multiplicity of LED elements and adapted to control the switching of individual LED elements in conformity with the information to be inscribed, a laser device adapted to control the switching of a laser beam in conformity with the data to be inscribed, or a liquid crystal shutter head thereby forming a desired additional image.

By the use of the conventional image forming apparatus endowed with an ability to inscribe the data of a date, however, since the date read from the clock IC is present date, the date on which the image is reproduced is inscribed on the copying paper. Where the date concurrent with the date of actual use of the reproduced copy is desired to be inscribed as described above, therefore, the reproduced copy must be produced on the date on which it is put to use. The ability of the image forming apparatus to inscribe a date is not fully utilized because the reproduced copy is not allowed by this image forming apparatus to be produced on a date different from the date on which the reproduced copy is actually used.

SUMMARY OF THE INVENTION

A main object of this invention is to provide an image forming apparatus capable of allowing a desired date to be inscribed on a copying paper without altering the data of present date.

A further object of this invention is to provide an image forming apparatus capable of making full use of an ability to inscribe a date as additional information.

In accordance with one aspect of the present invention, there is provided an image forming apparatus, comprising an image carrying member, electrostatic latent image forming means for forming an electrostatic latent image corresponding to an image of a document on the image carrying member, additional information recording means for forming an electrostatic image corresponding to additional information other than the image of said document, clock means giving data of present date, means for reading the data of present date from the clock means, storage means for storing the data of present date read by the reading means, renewal means for renewing the contents of the data of present date stored in the storage means, and control means for actuating the additional information recording means based on the data of date renewed by the renewal means.

In accordance with another aspect of the present invention, there is provided an image forming apparatus, comprising a photosensitive member, first exposure means for projecting an optical image corresponding to an image of a document onto the surface of the photosensitive member, additional information generating means for generating additional information other than the image of said document, a second exposure source for forming the image of additional information generated by the additional information generating means, a first memory for memorizing the data of present date, means for reading the data of present date from the first memory, a second memory for storing the date of present date read by the reading means, input means for receiving data of change to be used in effecting a necessary change of the data of present date stored in the second memory, means for executing the necessary change in the data of date stored in the second memory based on the data of change received in the input mean and for sending the data of date changed to the additional information generating means.

BRIEF DESCRIPTION OF THE DRAWINGS

FIGS. 10A–10E is a process flow chart illustrating the procedure for reproducing on a copying paper an image borne on a document in conjunction with additional data:

FIGS. 12(A)(1) and 12(A)(2) is a perspective view illustrating another set of data for inscription as formed on a copying paper:

FIG. 13 is a perspective view illustrating an editor;

DESCRIPTION OF THE PREFERRED EMBODIMENTS

Figure 1:
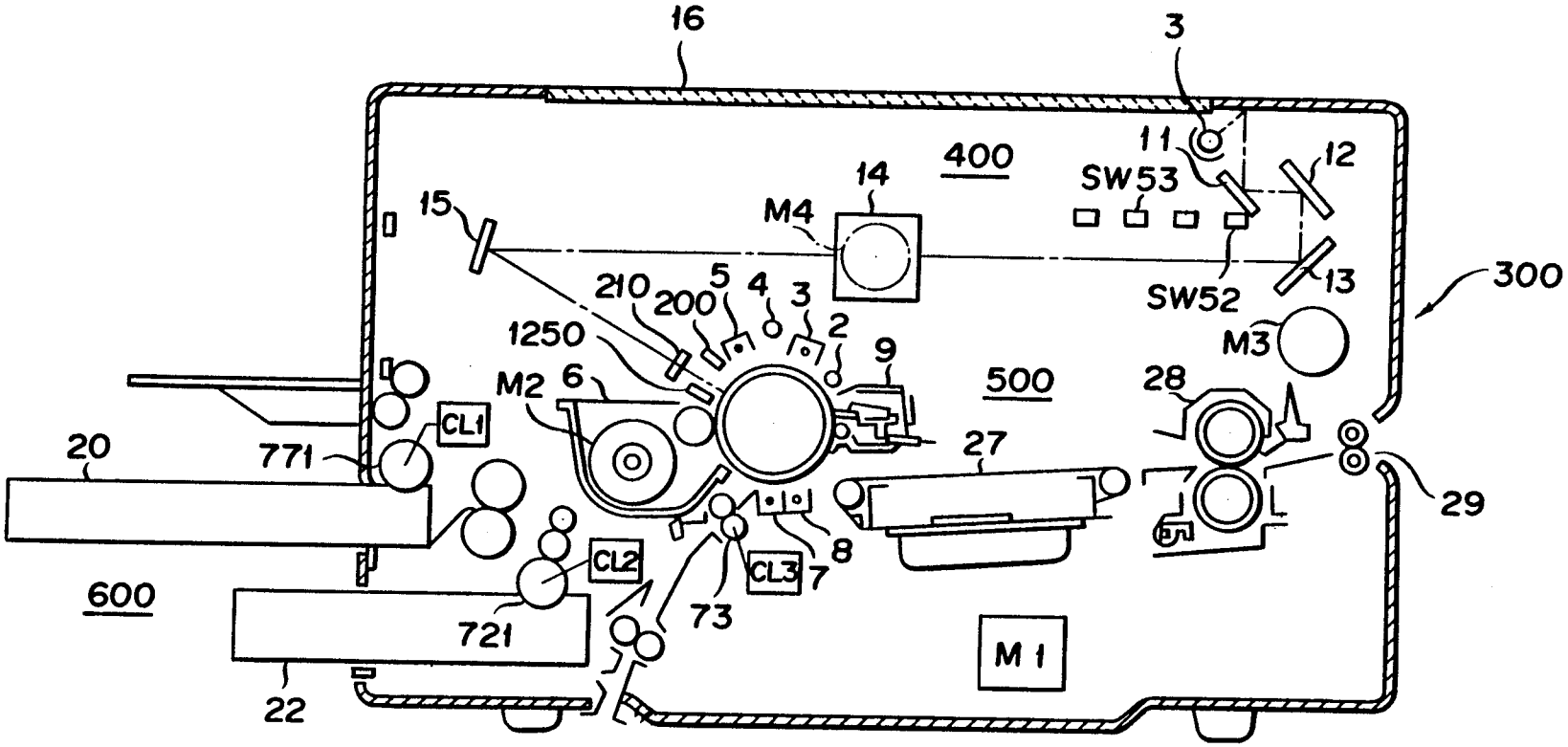
FIG. 1 is a cross section illustrating the internal structure of a copying machine as one embodiment of this invention.

FIG. 1 is a schematic diagram illustrating the internal structure of a copying machine. In a casing 300 of a copying machine illustrated, an optical system 400 is incorporated in the upper part thereof and an image forming part 500 is incorporated thereunder. To the left end part of the casing 300 in the bearing illustrated, a paper feeding part 600 is attached.

The optical system 400 scans with a projected light a document or subject copy mounted on a document table 16 made of a transparent material and focuses the light image reflected from the surface of the document on the surface of a photosensitive drum 1 of the image forming part 500.

The optical system 400 comprises a light source 3, movable mirrors 11, 12, and 13, a lens 14, and a stationary mirror 15. Between the stationary mirror 15 and the photosensitive drum 1 is disposed a liquid crystal shutter 210 which is adapted to shut off a light path laid therebetween when the apparatus is switched on. The light source 3 and the movable mirror 11 are driven at a speed of V/N by a scan motor M3 and reciprocated along the lower surface of the document table 16 and the movable mirrors 12 and 13 are driven by the motor M3 and reciprocated at a speed of V/2N, wherein V stands for the peripheral speed of the photosensitive drum 1 and N for the ratio of magnification of copying. The document is scanned with a projected light when these component members are moved to the left in the bearing illustrated. The optical system 400 is provided with an erase switch SW52 for the detection of the operating timing of an eraser and an image end switch SW53 for the detection of the leading end position of an image.

The ratio of copying magnification is set by adjusting the position of the lens 14 and that of the mirror 15 and the image focussing position is corrected by adjusting the angle of the mirror 15. The lens 14 and the mirror 15 are driven by a motor M4.

The image forming part 500 develops an electrostatic latent image formed on the photosensitive drum 1 into a toner image by the electrophotographic process, transfers the toner image onto a copying paper, fixes the toner image on the copying paper, and discharges the reproduced copy out of the system.

Around the photosensitive drum 1 attached to the image forming part 500 rotatably in the counterclock direction in the bearing illustrated, eraser lamps 2 and 4, electric chargers 3 and 5, a developing device 6 driven by a developing motor M2, a transfer charger 7, a separating charger 8, and a cleaning device 9 are disposed. Between the photosensitive drum 1 and the transfer charger 7, a pair of timing rollers 73 are juxtaposed to the transfer charger 7 so as to convey the copying paper at a prescribed timing as synchronized with the peripheral speed of the photosensitive drum 1. The pair of timing rollers 73 are driven by a main motor M1 in consequence of the operation of a clutch CL3. The copying paper to which the toner image has been transferred is conveyed by a conveyor belt 27 to a fixing device 28 to have the toner image fixed in the fixing device 28 and then is discharged by a pair of discharge roller 29. Further around the photosensitive drum 1, an mid-image eraser 200 and a data inscribing device 1250 are disposed. The main motor M1 mentioned above also drives the photosensitive drum 1, etc.

A paper feeding part 600 is provided with two paper feeding cassettes 20 and 21 for holding copying papers of two different sizes. These paper feeding cassettes are detachable relative to the casing 300. The copying papers in the paper feeding cassette 20 are fed by a paper feeding roller 771 and those in the paper feeding cassette 21 are fed by a paper feeding roller 772, respectively to the timing roller 73. The paper feeding roller 771 is driven by the main motor M1 in consequence of the operation of a clutch CL1 and the paper feeding roller 721 is driven by the main motor M1 in consequence of the operation of a clutch CL2. The copying papers are fed out into the gap between the photosensitive drum 1 and the transfer charger 7 as synchronized with the rotation of the photosensitive drum 1 in response to the prescribed timing signal from the optical system 400 to be processed therein for the reproduction of the image of the document.

Figure 2:
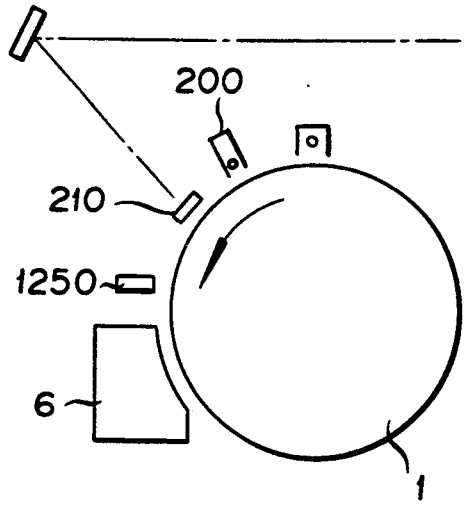
FIG. 2 is a magnified front view illustrating part of component members disposed around the periphery of a photosensitive drum.
Figure 3:
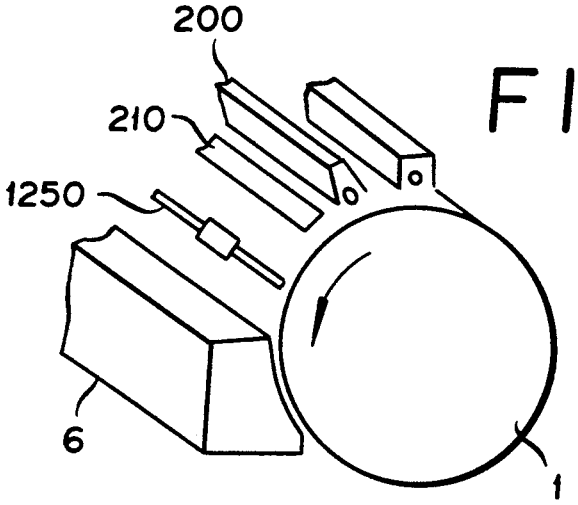
FIG. 3 is a perspective view of FIG. 2.

FIG. 2 and FIG. 3 illustrate, as magnified, the mid-image eraser 200, the liquid crystal shutter 210, and the data inscribing device 1250 which are disposed around the photosensitive drum 1 as described above. The mid-image eraser 200 has a multiplicity of LED elements arranged parallelly to the axial direction of the photosensitive drum 1. The beam of light from the mid-image eraser 200 erases the electric charge on the photosensitive drum 1 outside the effective image forming region and precludes the otherwise inevitable waste of the toner.

Figure 4:
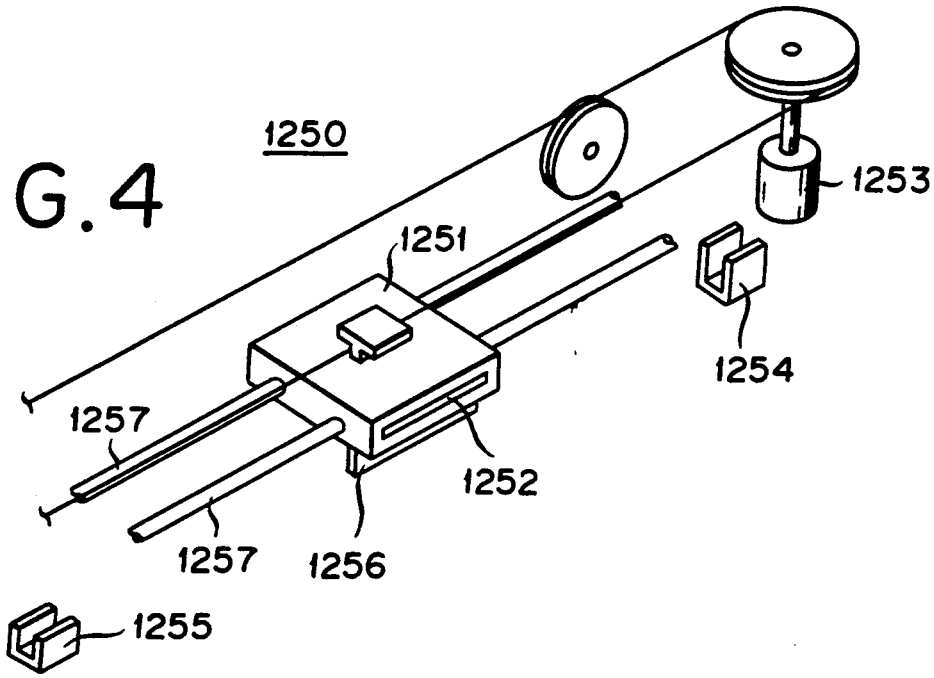
FIG. 4 is a perspective view illustrating a data inscribing device.
Figure 5:
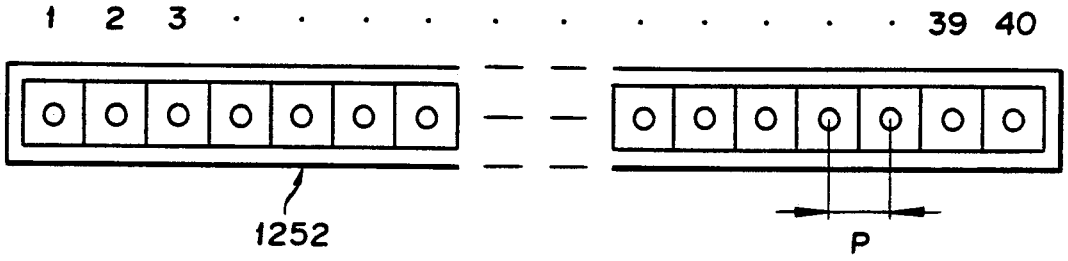
FIG. 5 is a front view illustrating a LED array disposed on a data inscribing head.

FIG. 4 is a diagram illustrating the data inscribing device 1250 as magnified. In this device, an inscribing head 1251 is moved in the axial direction of the photosensitive drum 1 along the surface of the photosensitive drum 1 as guided by a guide rails 1257. This inscribing head 1251 is provided with an LED array 1252 as illustrated in FIG. 5. This LED array 1252 has 40 LED (light emitting diode) elements arranged linearly as spaced by a fixed pitch, P, of 1 mm along the axial direction of the photosensitive drum 1. In FIG. 5, only part of the 40 LED elements is illustrated. For the purpose of moving the inscribing head 1251 along the guide rail 1257, a rope adapted to be driven by a motor 1253 is tied to the head 1251. At the opposite moving ends of the head 1251, sensors 1254 and 1255 for detecting the position of this head are disposed and are adapted each to be turned on and off by an interrupter 1256 attached to the lower end surface of head.

In the illustrated embodiment, the head 1251 is depicted as moved by the motor 1253. The LED array is not required to be moved when it is given a length equivalent to the length of the drum 1. As compared with the array of such a large length which is expensive, the LED array of such a small length as illustrated which is adapted to be moved along the length of the drum renders the head 1251 inexpensive.

Figure 6:
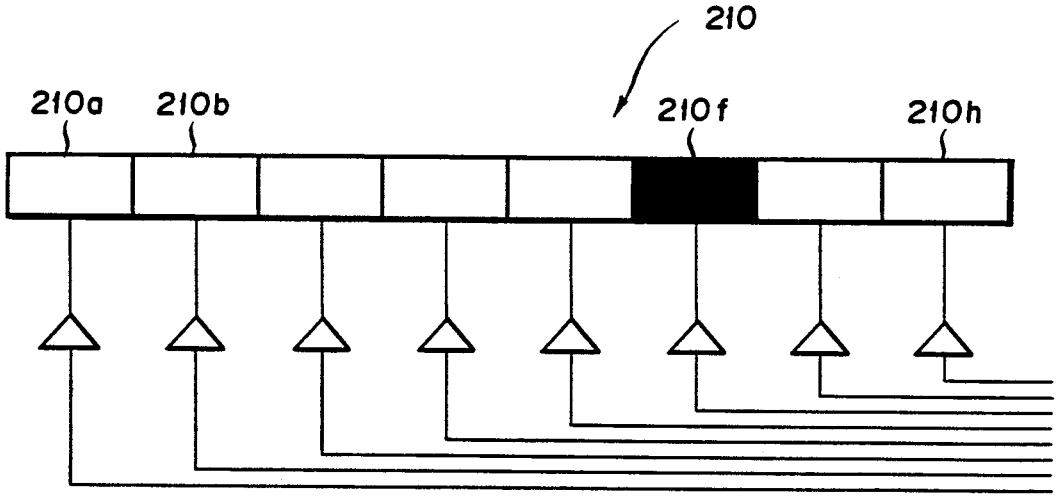
FIG. 6 is a schematic diagram illustrating the structure of a liquid crystal shutter.

FIG. 6 illustrates a liquid crystal shutter 210 shown in FIG. 1. This liquid crystal shutter 210 comprises a total of eight blocks 210*a* to 210*h* each of a length of 40 mm arrayed contiguously along the axial direction of the photosensitive drum 1. These blocks are independently turned on and off as controlled. When the signal from the first CPU shown in FIG. 8 turns on a certain driver, this driver turns on the corresponding one of the blocks. The block thus turned on intercepts the light path in a length of 40 mm as a unit proportionately to the length of the inscribing head 1251. In FIG. 6, the block 210*f* completely smeared in black represents a block which has been turned on to intercept the light path.

Figure 7:
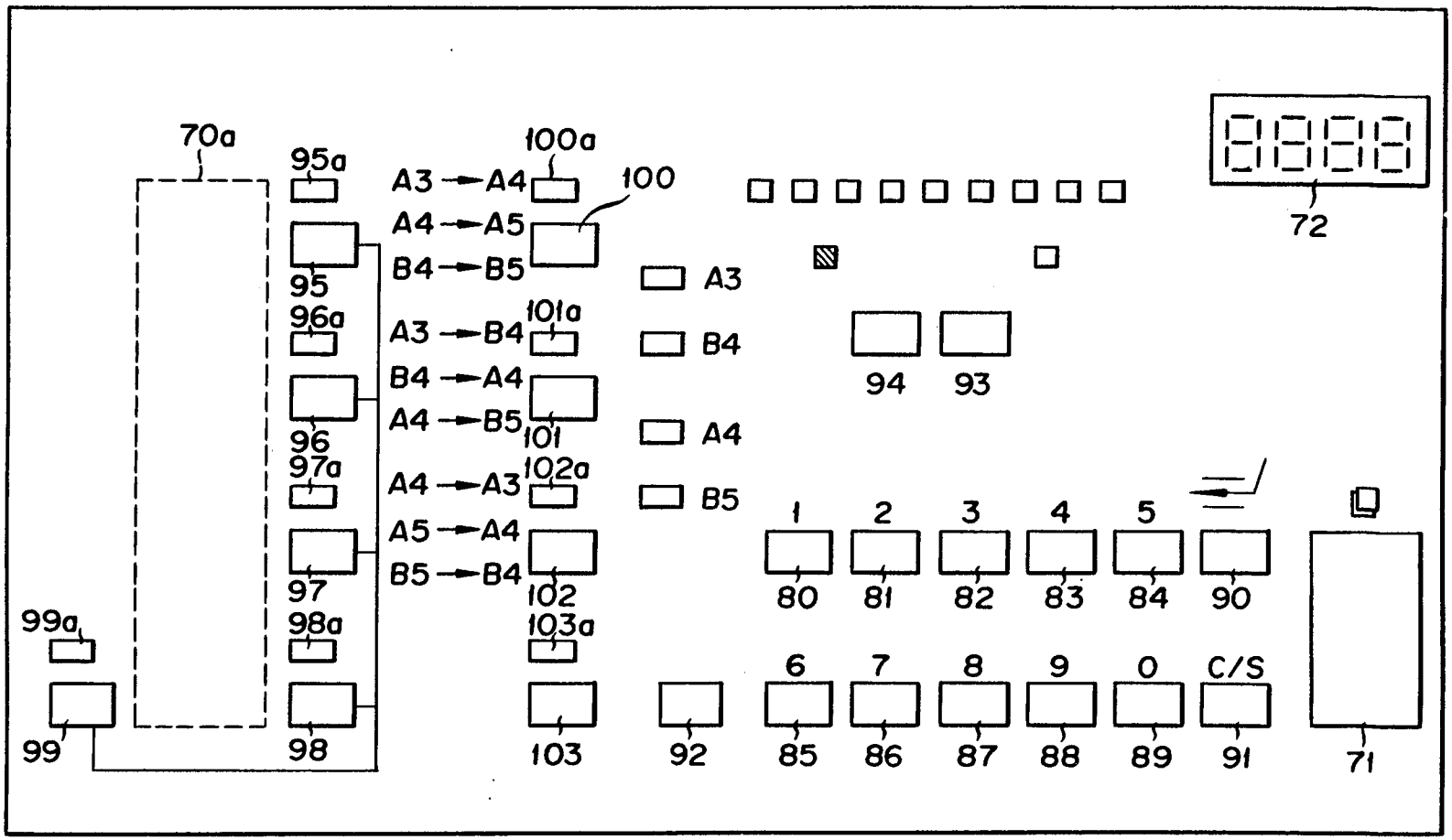
FIG. 7 is a plan view illustrating a console installed on a copying machine.

FIG. 7 illustrates the layout of various operating keys disposed on a console 70 of the copying machine. On this console 70 are disposed a print key 71 for starting the copying operation, a numeral display device 72 for displaying a four-digit numeral, ten keys 80 to 89 corresponding respectively to the numerals, 1, 2, . . . 9, and 0, an interruption key 90 for designation an interruption copying, a clear/stop key 91, a paper size selection key 92 for selecting either of the paper feeding cassettes set in place and designating the size of copying papers selected, an up key 93 and a down key 94 for gradually altering and designating the density of a copied image, and groups of keys 95 to 103 for arbitrarily setting the ratio of copying magnification.

The group of magnification setting keys 95, 96, 97, and 98 is operated for the user to set the ratio of magnification at a desired value. When the key 99 for switching the arbitrary magnification setting mode is operated, the control mode of the copying machine is switched to the magnification setting mode and the fact that the arbitrary magnification setting mode has been set is displayed on a display part 99*a*. When one of the keys 95 to 98 is operated in the ensuing state, the numeral introduced via the ten keys 80 to 89 and displayed on the display device 72 is memorized as a copying ratio in the memory corresponding to the operated key. In the illustrated embodiment, four magnification ratios of arbitrary selection are allowed to be memorized. When some of the keys 95 to 98 is operated, the fact that the key has been operated is displayed on the display parts 95*a* to 98*a*.

The group of magnification setting keys 100, 101, 102, and 103 is operated when the copying is performed at the prescribed ratio of magnification memorized correspondingly. When one of these keys is operated, the fact that the key has been operated is displayed on the display lamp 100*a*, 101*a*, 102*a* or 103*a*.

Figure 8:
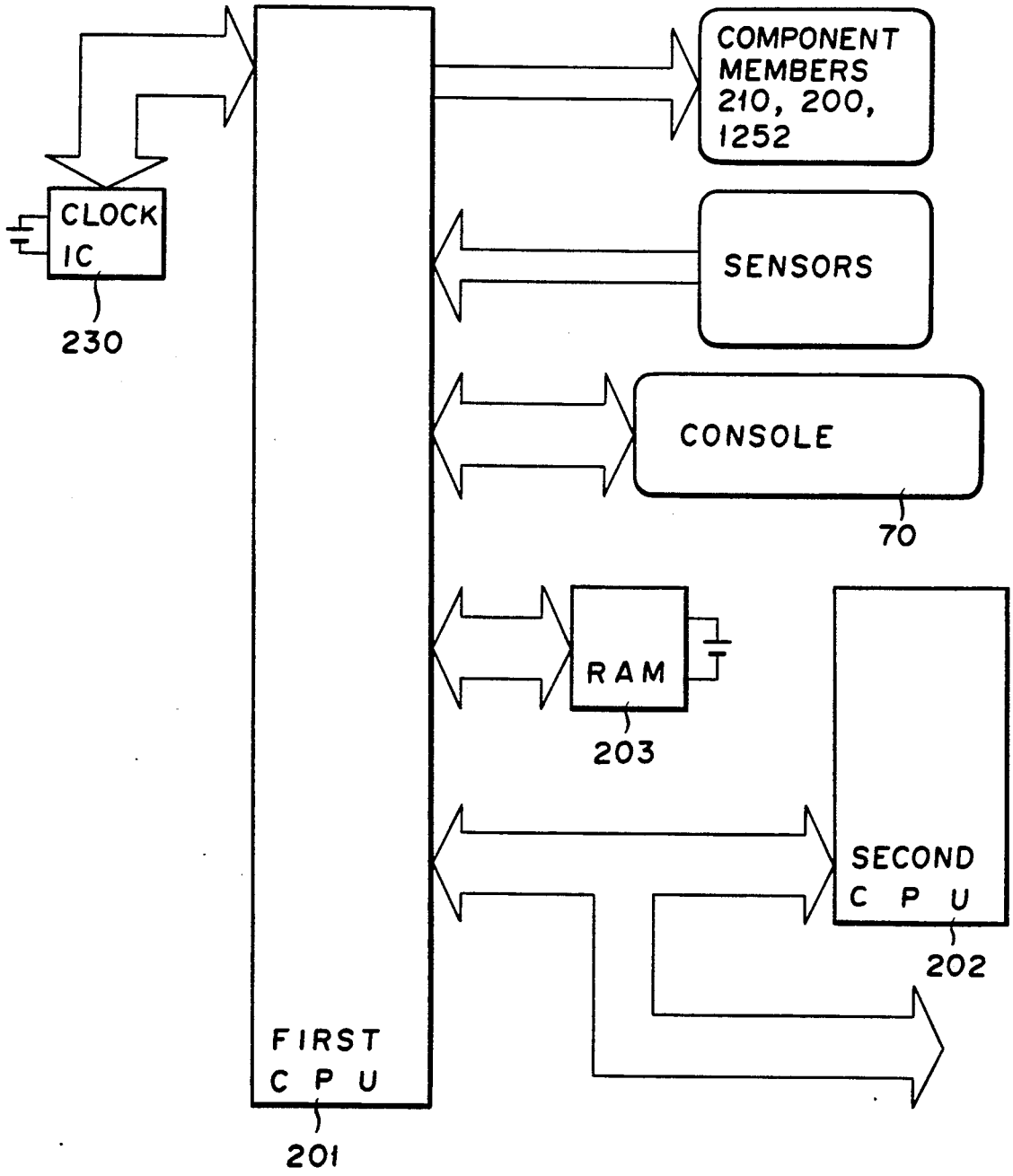
FIG. 8 is a block diagram illustrating a control circuit for a copying machine.

FIG. 8 illustrates a control circuit incorporated in the illustrated copying machine. The control circuit comprises the first CPU 201 for controlling the operation of component members in the image forming part 500, a second CPU 202 for controlling the operation of the component members in the optical system 400, a RAM 203 backed up by a power source such as a battery so as to memorize an arbitrarily set ratio of magnification, and a clock IC 230 backed up by a power source such as a battery so as to display present time and date on the console.

The first CPU 201 issues operation control signals to the operating members in the copying machines, e.g. the mid-image eraser 200, the liquid crystal shutter 210, and the data inscribing head 1251 and, at the same time, receives signals from the sensors incorporated in the copying machine. Further, the first CPU 201 receives the signals from the keys disposed on the console 70 and controls the switching of the display parts corresponding to the keys. The first CPU 201 performs communication with the third CPU 204 illustrated in FIG. 16 and described specifically hereinafter.

Figure 9:
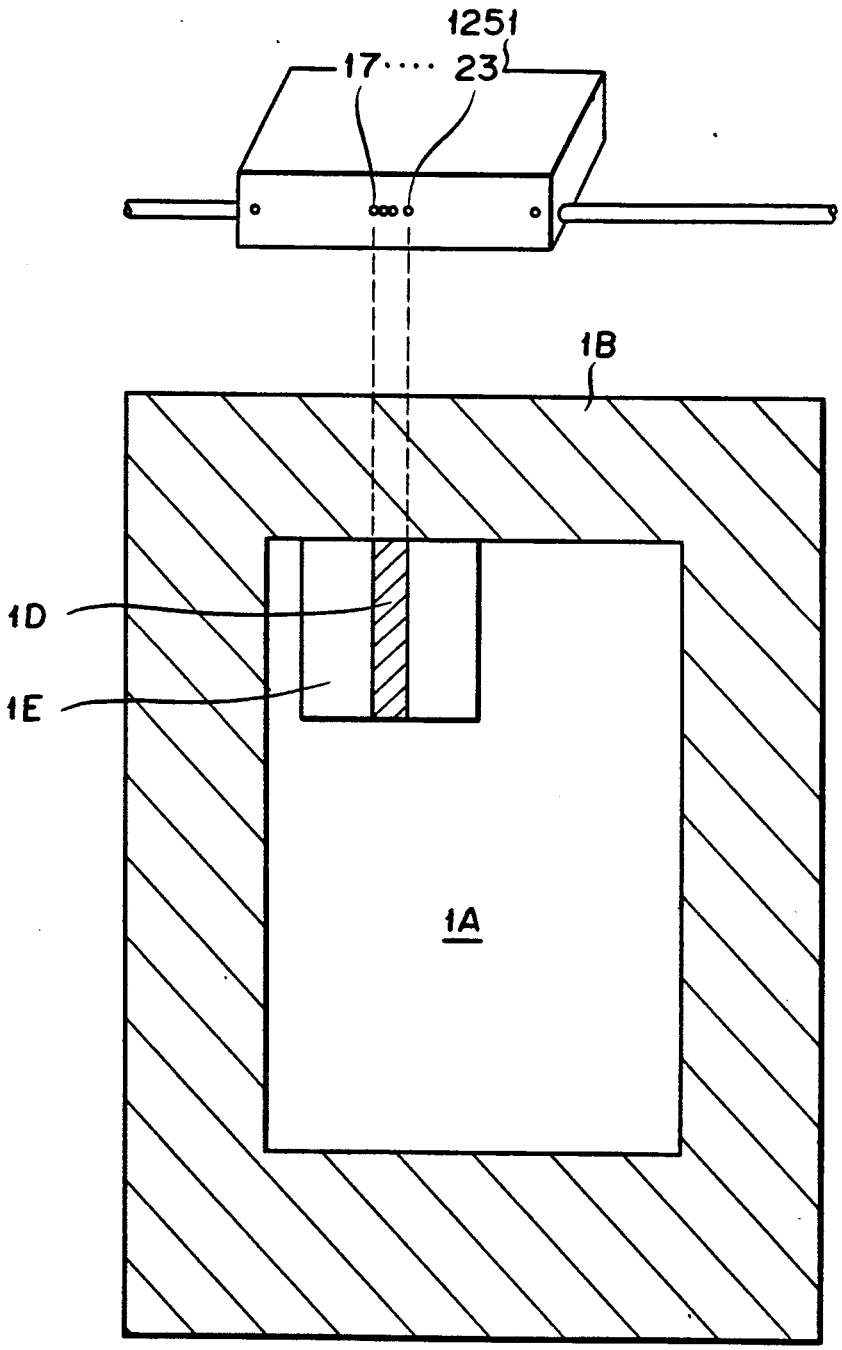
FIG. 9 is an explanatory diagram illustrating the positional relation between an inscribing head and a latent image on a photosensitive drum.

FIG. 9 is a diagram illustrating the positional relation between the data inscribing head 1251 and the latent image on the photosensitive drum 1. This inscribing head 1251 is moved to and fixed by the motor 1253 at the data inscribing position designated by an inscribing area designating device (hereinafter referred to as "editor") 2000 which is described more specifically hereinafter. In FIG. 9, the reference numeral 1A denotes a document area and the reference numeral 1B a document outside area erased by the mid-image eraser 200, and the reference numeral 1E a data inscribing area designated by the editor 2000 mentioned above. The hatched part of the reference numeral 1D represents the part in which the head inscribes data. In the illustrated case, the data are inscribed in the longitudinal direction of data, namely in the direction of motion of the peripheral surface of the photosensitive drum 1. In this case, the data are inscribed by the use of seven LED elements, No. 17 to No. 23, of the LED array 1252. The remaining LED elements, namely those of No. 1 to No. 16 and No. 24 to No. 40 serve the purpose of erasure. In this case, the block 210*b* in the liquid crystal shutter 210 shown in FIG. 6 is caused to intercept the light path in the portion of area 1E in a length of 40 mm. Each of the component LED elements in the LED array 1252 has the ON time and OFF time thereof controlled at a pitch of 1 mm relative to the peripheral surface of the drum 1 and proportionately to the rotating speed of the photosensitive drum 1.

FIGS. 10A–10E is a diagram illustrating an image reproducing process involved in the reproduction on a copying paper of an image borne on a document. This diagram depicts the case in which the data of a date is inscribed on a document 240 denoted by the letter "F"

and the image is reproduced on a copying paper 243. The document 240 is mounted in place in such a manner that the surface thereof is directed to the document table 16. When the copying is started, a latent image 241 of the document and a latent image 242 of the data for inscription are concurrently formed on the peripheral surface of the photosensitive drum 1 and these latent images are reproduced on the copying paper 243. The data for inscription are formed in the longitudinal direction on the upper right side of the copying paper, namely in the direction of travel of the peripheral surface of the drum 1.

Figure 11:
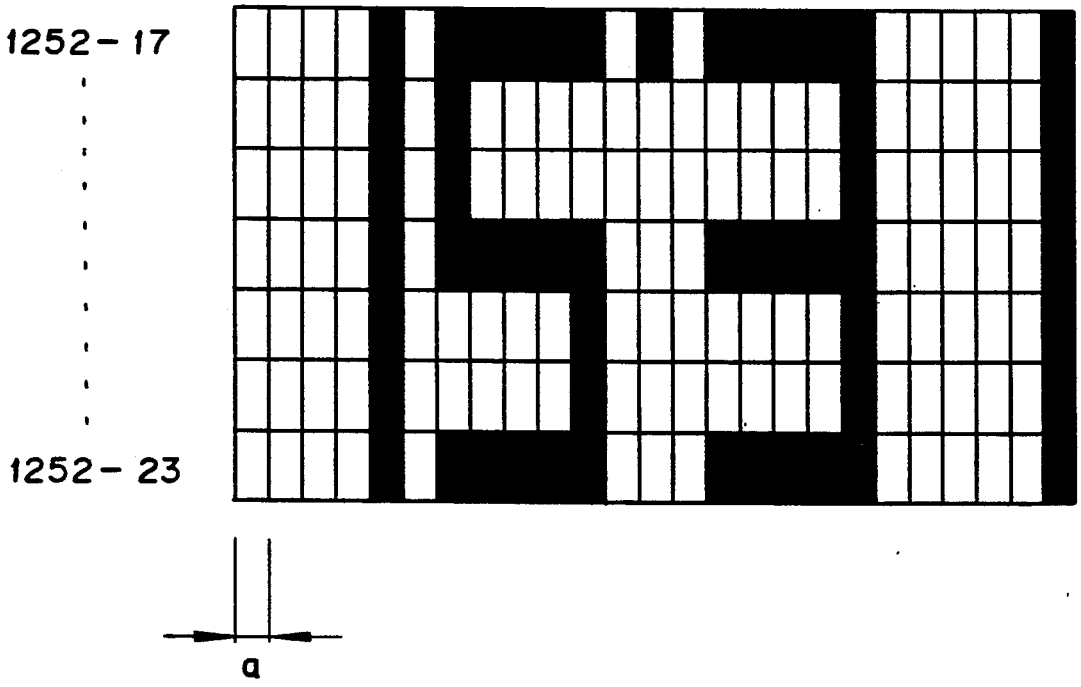
FIG. 11 is a magnified explanatory diagram illustrating a typical set of data for inscription formed as a latent image on a photosensitive member.

FIG. 11 illustrates a dot matrix for inscribing the data of a date, "12.31" signifying the date of December 31, in the longitudinal direction on the copying paper 243 as illustrated in FIG. 10. Since this dot matrix represents the data to be formed on the peripheral surface of the photosensitive drum 1, it is the opposite of the data reproduced on the coping paper in the obverse and reverse relation. The LED units of Nos. 17 to 23 in the LED array 1252 shown in FIG. 5 are controlled so as to be turned on and off in the prescribed order in accordance with the rotation of the photosensitive drum 1.

To form the latent image of the data of date "12.31" on the peripheral surface of the drum 1, the LED units of Nos. 17 to 23 are wholly turned on while the peripheral surface of the drum 1 advances over the pitch 4*a* and the LED units (Nos. 17 to 23) are wholly turned off while the peripheral surface advances over the pitch 1*a*. As the result, the latent image of "1" is inscribed on the drum 1. Subsequently, after the drum 1 has been rotated over the pitch 1*a* while the LED units are wholly kept in the ON state, the drum 1 is rotated over 1 pitch 1*a* with the LED units of Nos. 21 and 22 kept in the ON state and the other LED units in the OFF state. Further, the drum is rotated over 3 pitches 3*a* with the LED units of Nos. 18, 19, 21, and 22 in the ON state and the other LED units in the OFF state. Then, the LED units of Nos. 18 and 19 are kept in the ON state and the other LED units in the OFF state for a time interval equivalent to 1 pitch. As a result, the latent image of "2" is formed on the peripheral surface of the photosensitive drum 1. The latent image of this numeral "2" is formed as reversed in the obverse and reverse relation. By repeating this procedure with necessary modifications, "." and "3" and "1" are inscribed as illustrated in FIG. 11.

The latent images which are formed in the longitudinal direction on the peripheral surface of the photosensitive drum 1, namely in the direction of travel of the peripheral surface, the data are reproduced on the copying paper 243 as illustrated in FIG. 10.

FIGS. 12(A)(1) and 12(A)(2) illustrate the copying paper 243 on which the data, "X0.824" of copying magnification ratio as data for inscription in the corner part on the copying paper 243 has been formed sideways.

Figure 12B:
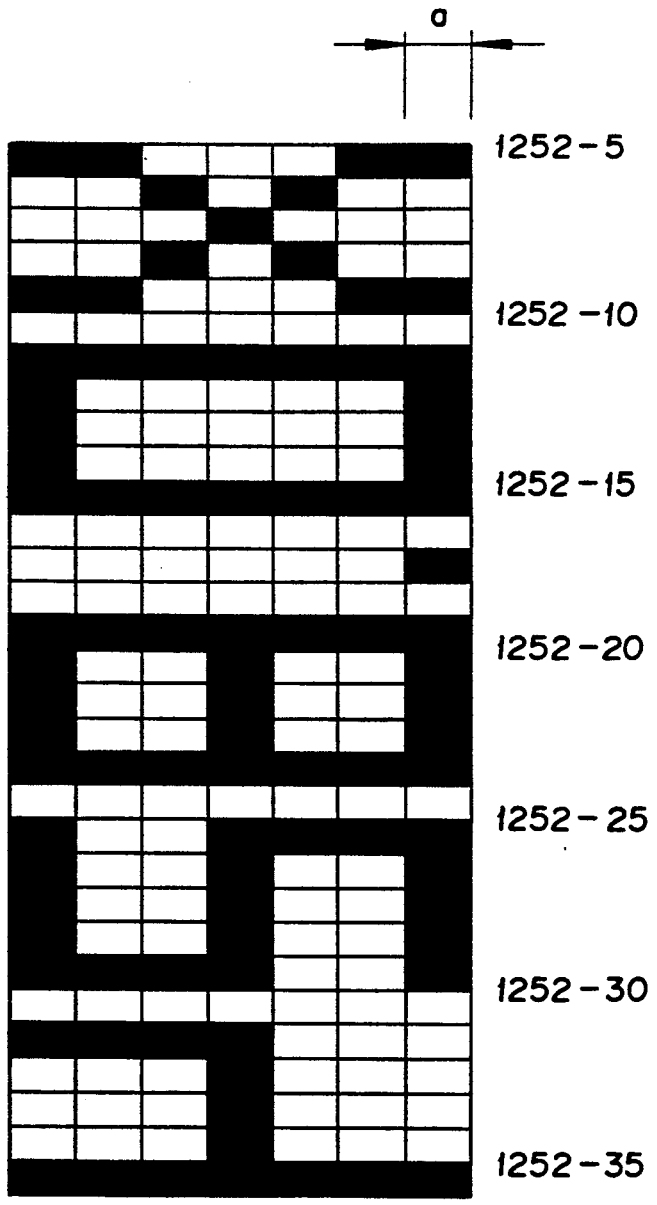
FIG. 12B is a magnified explanatory diagram illustrating the data shown in FIG. 12A as formed in the form of a latent image on a photosensitive drum.
Figure 12B:
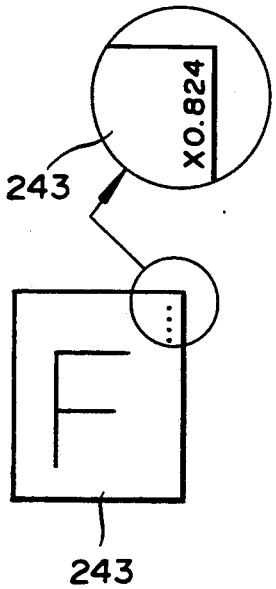

FIG. 12B is a diagram illustrating a dot matrix for inscription of the data of magnification ratio on the copying paper 243. In this case, the inscription is effected by following the same procedure as that for the inscription of the data of date described above by using 31 of the LED units (Nos. 5 to 35) of the LED array 1252 as illustrated in FIG. 12B. The data of this copying ratio is obtained when the magnification ratio is set by the operation of the console 70 shown in FIG. 7 in conformity with the designation to be made by the operation of the editor 2000 which will be specifically described hereinafter.

Optionally the letters and numerals indicating a date and a magnification ratio as data for inscription may be displayed on the numeral display device 72 on the console 70 through the first CPU 201.

FIG. 13 illustrates the editor 2000 for designating the edition area and the data inscribing area. This editor comprises an area designating part 2140, a console 2110, and a liquid crystal display part 2100 for displaying the data to be inscribed.

Figure 14:
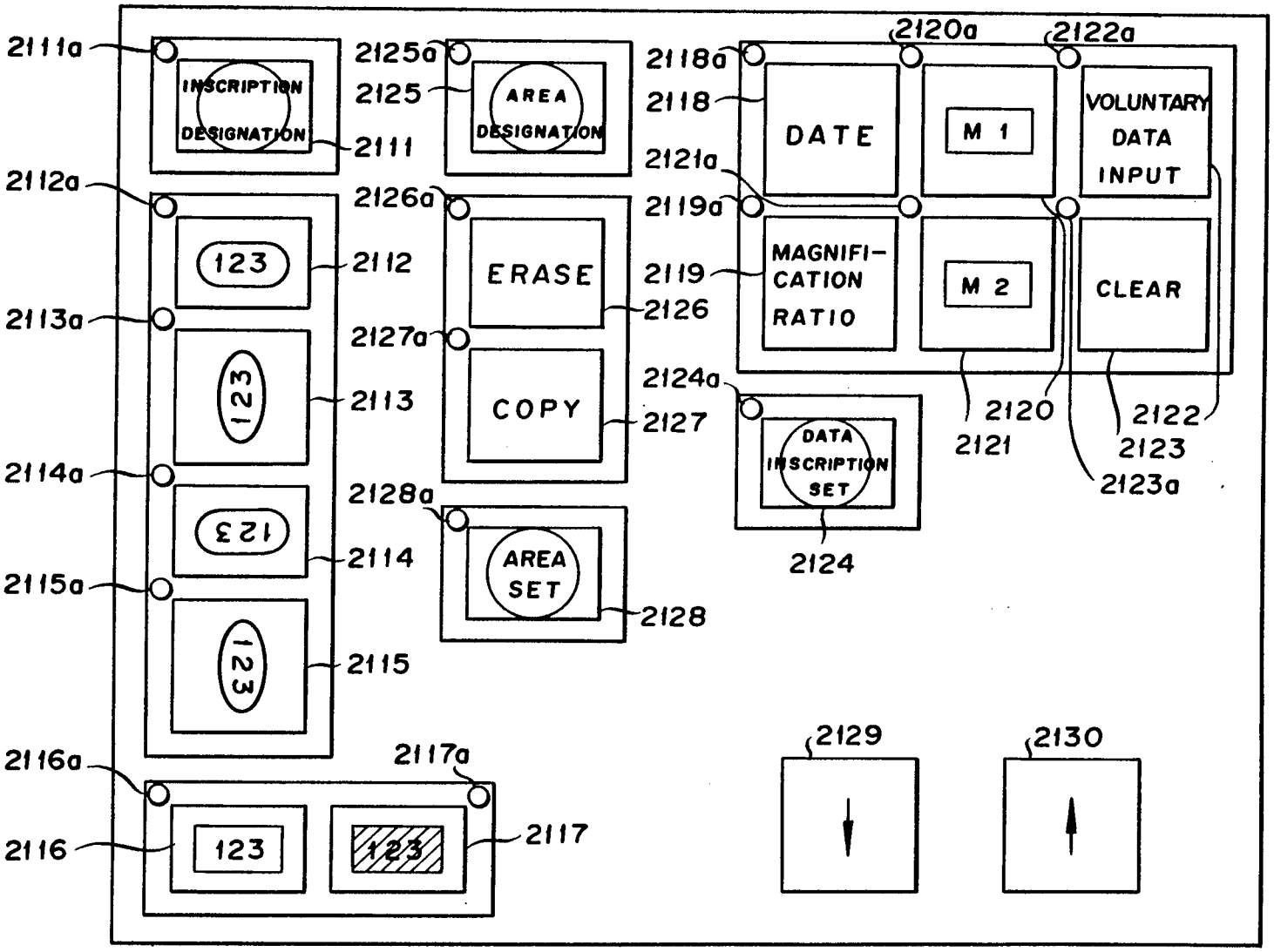
FIG. 14 is a plan view illustrating a console installed on the editor.

FIG. 14 is a diagram illustrating in detail the console 2110 shown in FIG. 13. On this console 2110 are disposed keys 2111 to 2128 and LED's 2111*a* to 2128*a* corresponding to the keys. The key 2111 is intended to be operated in inputting the position of the data for inscription, the keys 2112 to 2115 in designating the direction of data for inscription, the keys 2116 and 2117 in designating the negativeness or positiveness of the image of the document, the key 2118 in effecting the inscription of the date as the data for inscription, the key 2119 in effecting the inscription of the copying magnification ratio as data for inscription, the keys 2120 and 2121 in allowing the user to memorize desired data for inscription, the key 2122 in effecting the introduction of desired data as input, the key 2123 in clearing erroneous input, and the key 2124 in setting the designation of the data for inscription. Then, the key 2125 is operated in designating an area for editing an image, the key 2126 in effecting erasure, and the key 2127 in designating a copy, the key 2128 in inputting the fact that the designation of an area for the edition of an image has been completed, the keys 2129 and 2130 in designation an alteration in the date to be inscribed. The key 2129 is intended to be operated in setting back the date, and the key 2130 in advancing the date.

Figure 15:
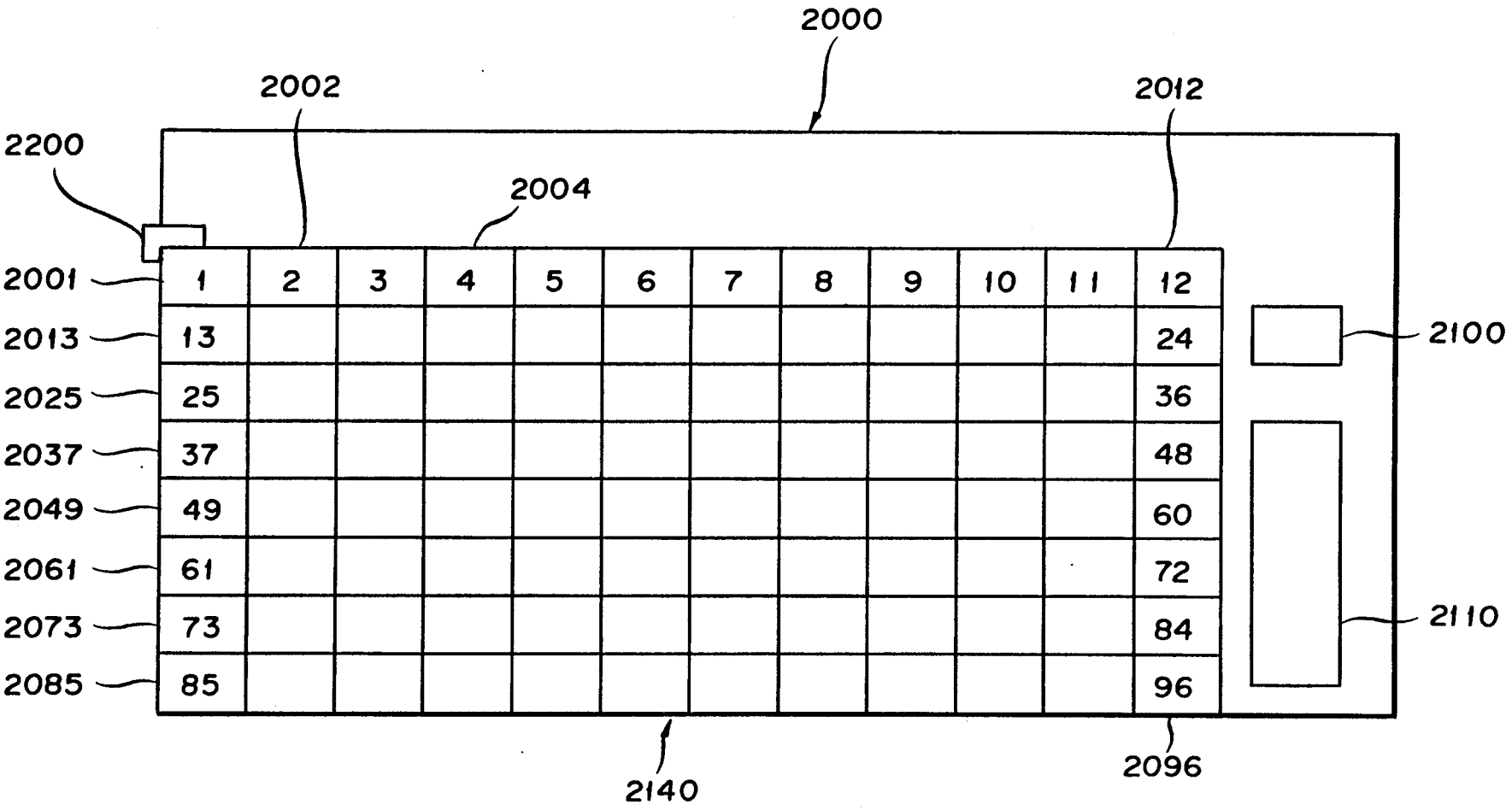
FIG. 15 is a plan view illustrating a data inscribing area for edition provided on a console.

FIG. 15 is a magnified plan view of the editor 2000 shown in FIG. 13 which illustrates the editor designating part 2140 as magnified. On the editor designating part 2140, a total of 96 keys, 2001 to 2096, marked respectively with symbols 1 to 96 are arrayed in 8 rows and 12 files. These keys each designate an area of 40 mm×40 mm. In the editing of an image, the part of each of these keys can be designated as one block of the smallest unit. In the inscription of data, the data is written in certain of the blocks. In FIG. 15 most of the identifying numbers and reference numerals of the keys are omitted to ensure legibility of diagram. For better comprehension of the correspondence between the position of data inscribed in the document and that of the pertinent key, a document aligning corner 2200 is disposed freely slidably in the horizontal direction.

When certain of the keys 2001 to 2096 is operated while the document is kept mounted on the editor designating part 2140, the position of the data to be inscribed can be easily perceived and designated.

Figure 16:
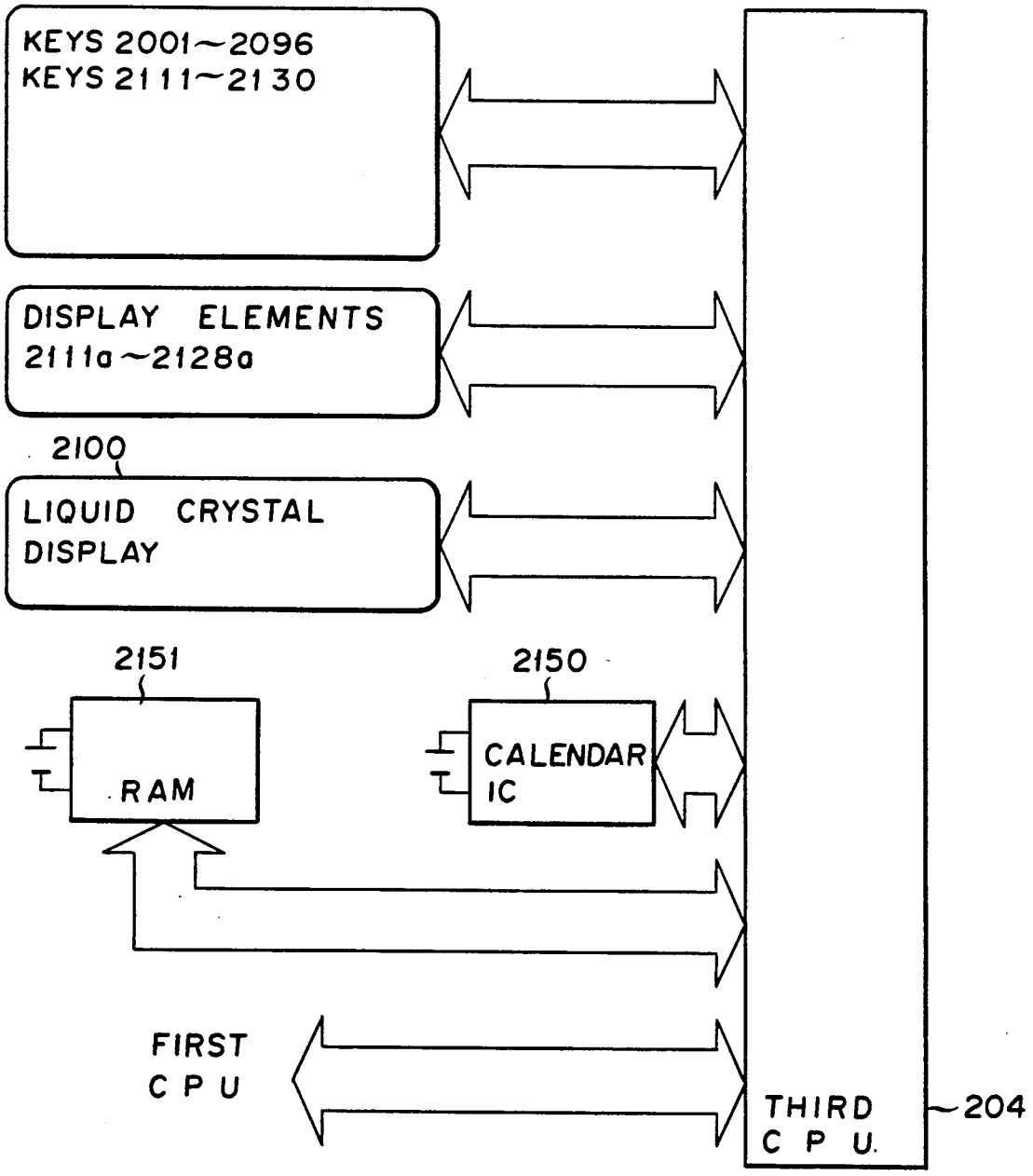
FIG. 16 is a block diagram illustrating a control circuit for an editor.

FIG. 16 is a diagram illustrating the input-output structure of the third CPU 204 for controlling the editor 2000.

As illustrated in the diagram, the third CPU 204 is so adapted as to receive the input signals from the keys 2001 to 2096 and the keys 2111 to 2130 and issues drive signals to the display elements 2111*a* to 2128*a* and the liquid crystal display part 2100. The third CPU 204 further reads the data of present date from a calendar IC 2150 backed up by a battery. This calendar IC 2150 resembles the clock IC 230 connected to the first CPU 201 and memorizes the present date. The data of dates in this calendar IC 2150 are caused, when necessary, to be memorized in the RAM 2151 backed up by a battery.

This third CPU 204 executes communication with the first CPU 201 shown in FIG. 8.

Figure 17:
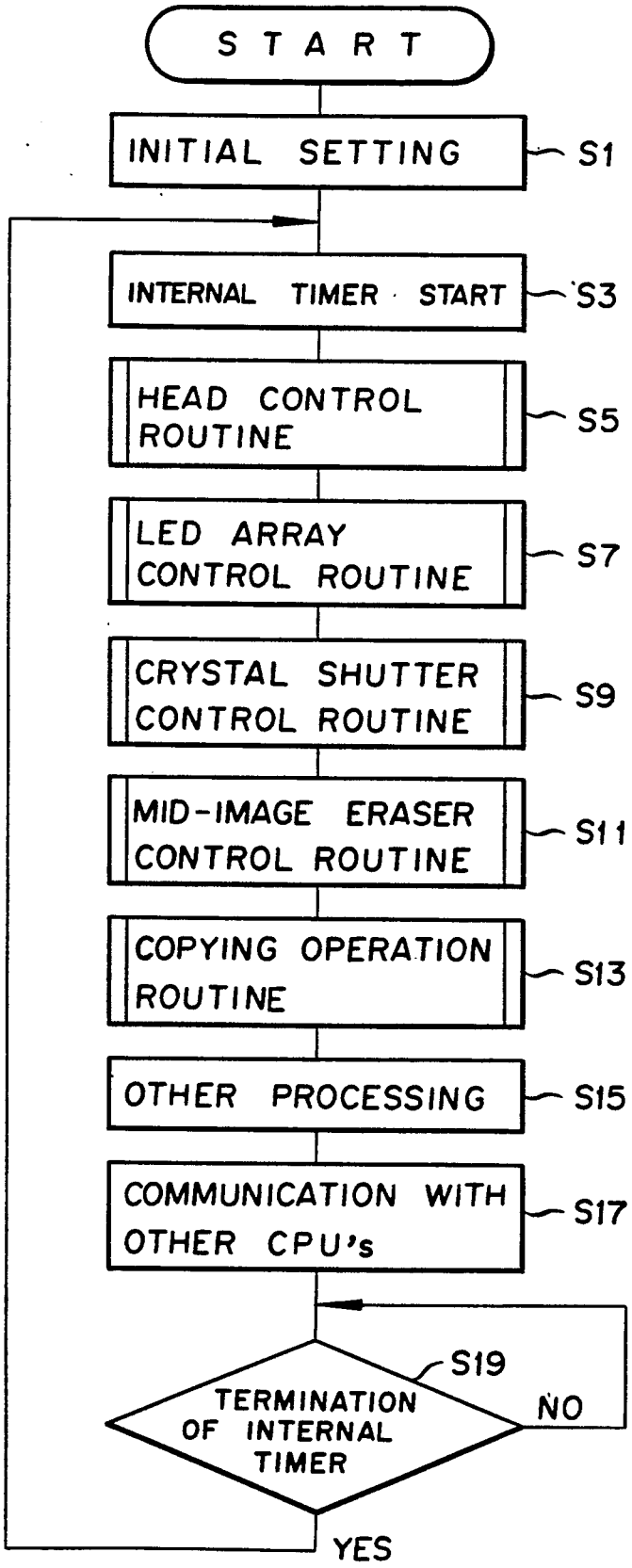
FIG. 17 is a main flow chart illustrating a control process of a copying machine.

FIG. 17 illustrates a main flow chart of the first CPU 201 for the control of the operation of the copying machine. When the first CPU 201 is reset, the program is started and the initial setting is executed in Step S1. As a result, the RAM 203 is cleared, the registers are set, the first CPU 201 is initialized, and the apparatus is further set to the initial mode. At Step S3, the internal timer set by the initial setting is started. Steps S5 to S17 shown in FIG. 17 are sequentially called.

The head control sub-routine of Step S5 is intended to control the position of the inscribing head 1251 show in FIG. 4. The LED array control sub-routine of Step S7 is intended to control the lighting of the LED elements disposed in the LED array 1250. The liquid crystal shutter control sub-routine of Step S9 is intended to control the opening and closing of the liquid crystal shutter 210. The mid-image eraser control sub-routine of Step S11 is intended to control the mid-image eraser 200. The copying operation sub-routine of Step S13 is intended to control the copying operation.

When all of the sub-routines have completed their pertinent processings, one routine (of Step S19) is completed when the initially set internal timer completes its operation. The various timers which take part in the sub-routines count time with the length of time of this one routine as the unit. The operating durations of these timers are such that their terminations are discerned by finding how often the timers have counted the routine.

The first CPU 201 starts data communication with other CPU's (Step S17) only after they have called all of the sub-routines.

Figure 18:
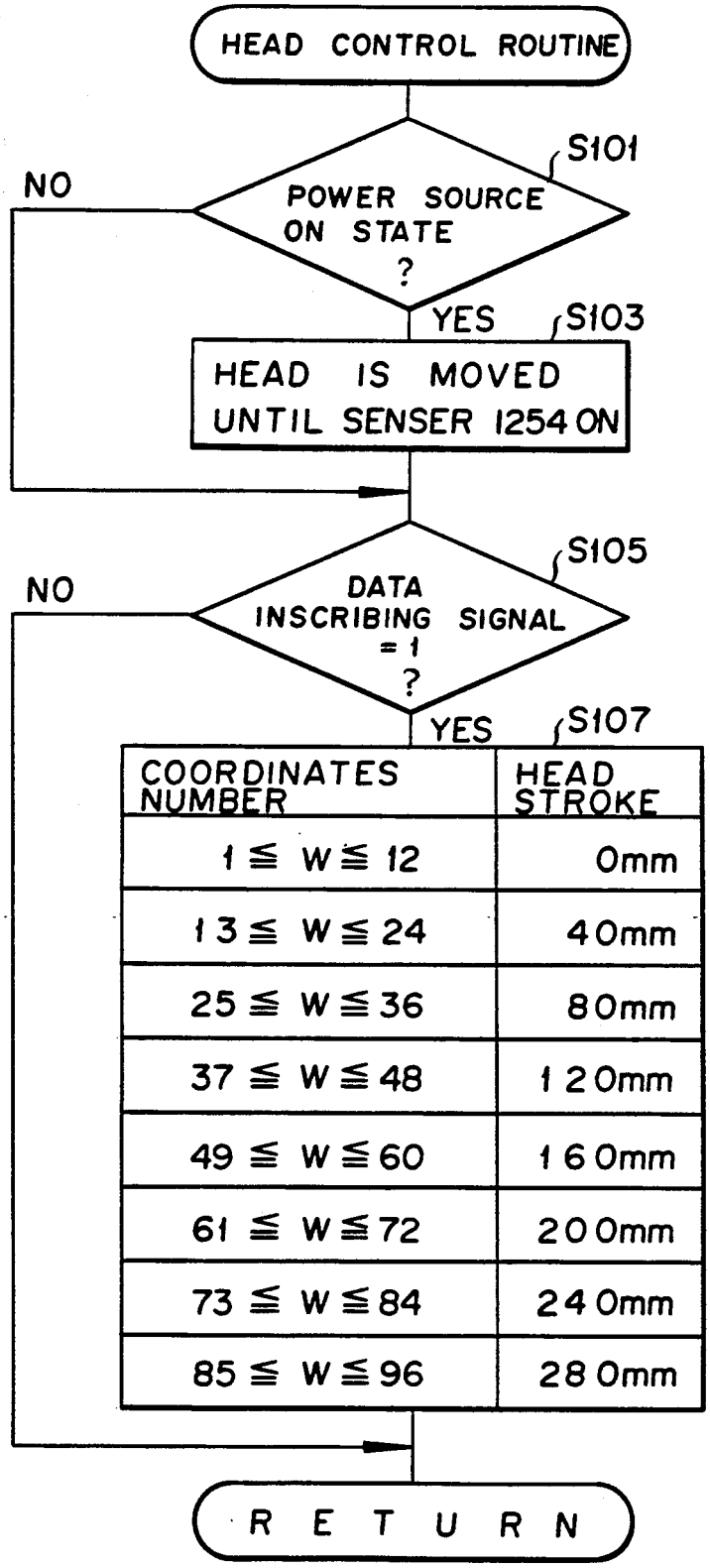
FIG. 18 is a flow chart illustrating a head control sub-routine.

FIG. 18 illustrates the head control sub-routine of Step S5 shown in FIG. 17. When the power source is judged to be in the ON state at Step S101, the processing of Step S103 is executed and the inscribing head 1251 is moved by the motor 1253 until the sensor 1254 shown in FIG. 4 is turned on and thus is brought to the initially set position. The processing of Step S107 is executed when the data inscribing signal is judged to have been set to "1" at Step S105.

At Step S107, when any one of keys 2001 to 2012 marked by the symbols 1 to 12, among other keys shown in FIG. 15, is operated, the head 1251 is not moved but is retained at the initial position. When any one of the keys marked by the symbols 13 to 24 is operated, the head 1251 is moved by 40 mm from the initial position and shifted to the adjoining file. By the same token, when any one of the keys 2025 to 2036 marked by the symbols 25 to 36 is operated, the head 1251 is moved by 80 mm from the initial position. The relation between the position of the operated key and the stroke with which the head is shifted is shown in the table of Step S107. In this table, the symbol W denotes the number indicated on the key shown in FIG. 15, namely the coordinates number.

Figure 19:
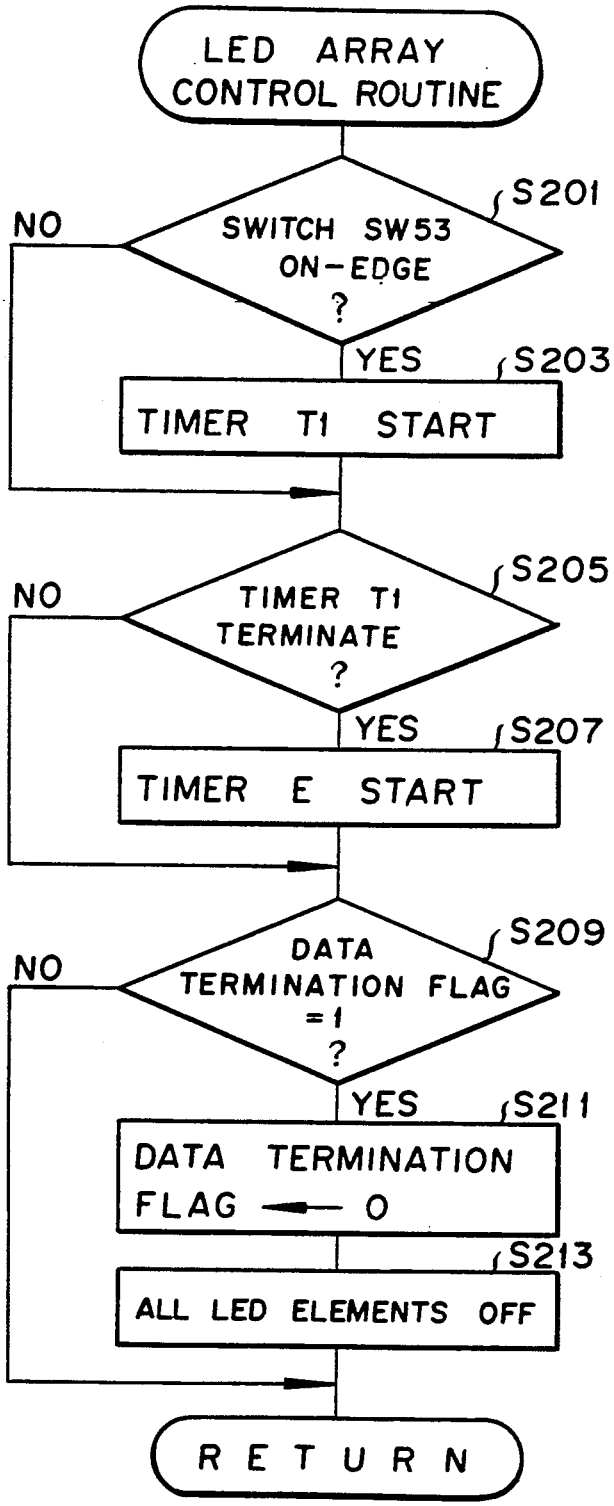
FIG. 19 is a flow chart illustrating a LED array control sub-routine.

FIG. 19 illustrates the LED array control subroutine of Step S7 shown in FIG. 17. When the image end detection switch SW53 shown in FIG. 1 is judged to have assumed the on-edge state by the scanner of the optical system 400 at Step S201, the timer T1 is started at Step S203. The term "on-edge" shown in the flow chart is defined as the state which is assumed when a switch or a sensor has shifted from the OFF state to the ON state. The timer T1 is intended to count the distance from the leading end of the image to the position at which the inscribing head 1251 inscribes the data. When the area for inscription is designated by the operation of the key 2004 marked by the number "4" in FIG. 15, for example, the time equivalent to the distance from the leading end of the image to the point for starting the inscription is found as (40 mm)×3÷scanning speed. Here, the magnitude, 40 mm, represents the length of one block of the data inscribing area 1E shown in FIG. 9 in the longitudinal direction, i.e. along the direction of travel of the peripheral surface of the photosensitive drum 1.

The operating duration of the timer T1 is judged to have terminated at Step S205, the timer E is started at Step S207. This timer E is intended to control the operating durations of the individual LED elements of the inscribing head 1251 per data. In the illustrated embodiment, since the width of data to be formed by one LED element is fixed at 1 mm, the operating duration of each LED element required for the distance of travel of the peripheral surface of the drum 1 to total 1 mm, namely 1 mm/drum speed, is the time set for the timer E. Thus, when one of the LED elements of the LED array 1252 is kept lit for one unit, the portion of the pattern having an area of the square of 1 mm is erased.

Figure 20:
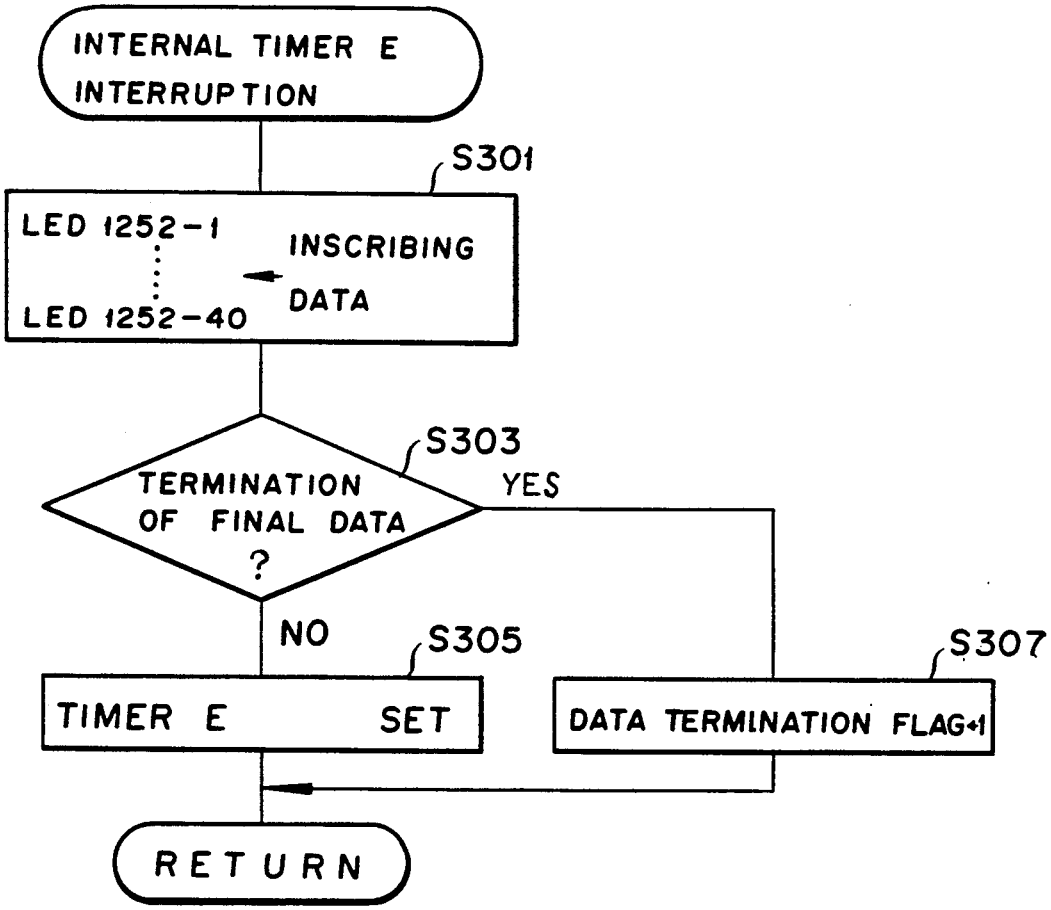
FIG. 20 is a flow chart illustrating an internal timer interrupt sub-routine.

When the timer E is started, a timer interruption is executed and the interruption routine shown in FIG. 20 is started. When the interruption is executed, the LED elements of Nos. 1 to 40 of the inscribing head are controlled by the inscribing data supplied from the third CPU at Step S301. Thus, the LED elements (Nos. 1 to 40) of the LED array 1250 are caused to emit light in accordance with the inscribing data. When the inscribing data are judged to be no final data at Step S303, the timer E is set at Step S305. When they are judged to be final data at Step S303, the data termination flag is set at "1." The interruption routine shown in FIG. 20 is executed when the timer E has completed the counting of time and is reset. When the internal timer E is not set, the interruption is not executed. As a result, the data termination flag is set at "1" and the interruption is terminated. When the data termination flag is judged to have been set at "1" at Step S209 shown in FIG. 19, the data termination flag is reset at "0" at Step S211 and all of the LED elements are turned off at Step S213.

Figure 21A:
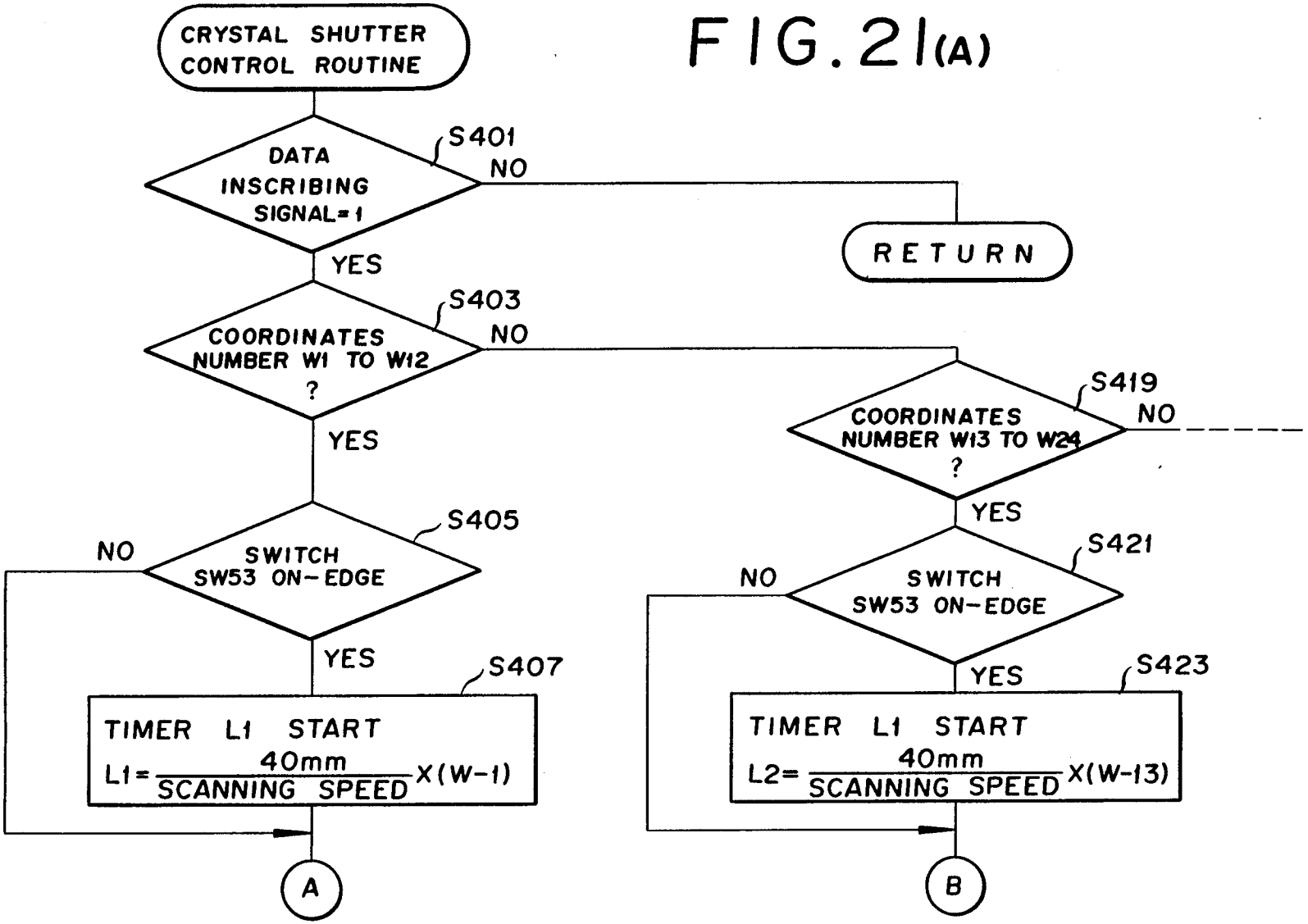
FIGS. 21A and 21B are each a flow chart illustrating a liquid crystal shutter control sub-routine.
Figure 21B:
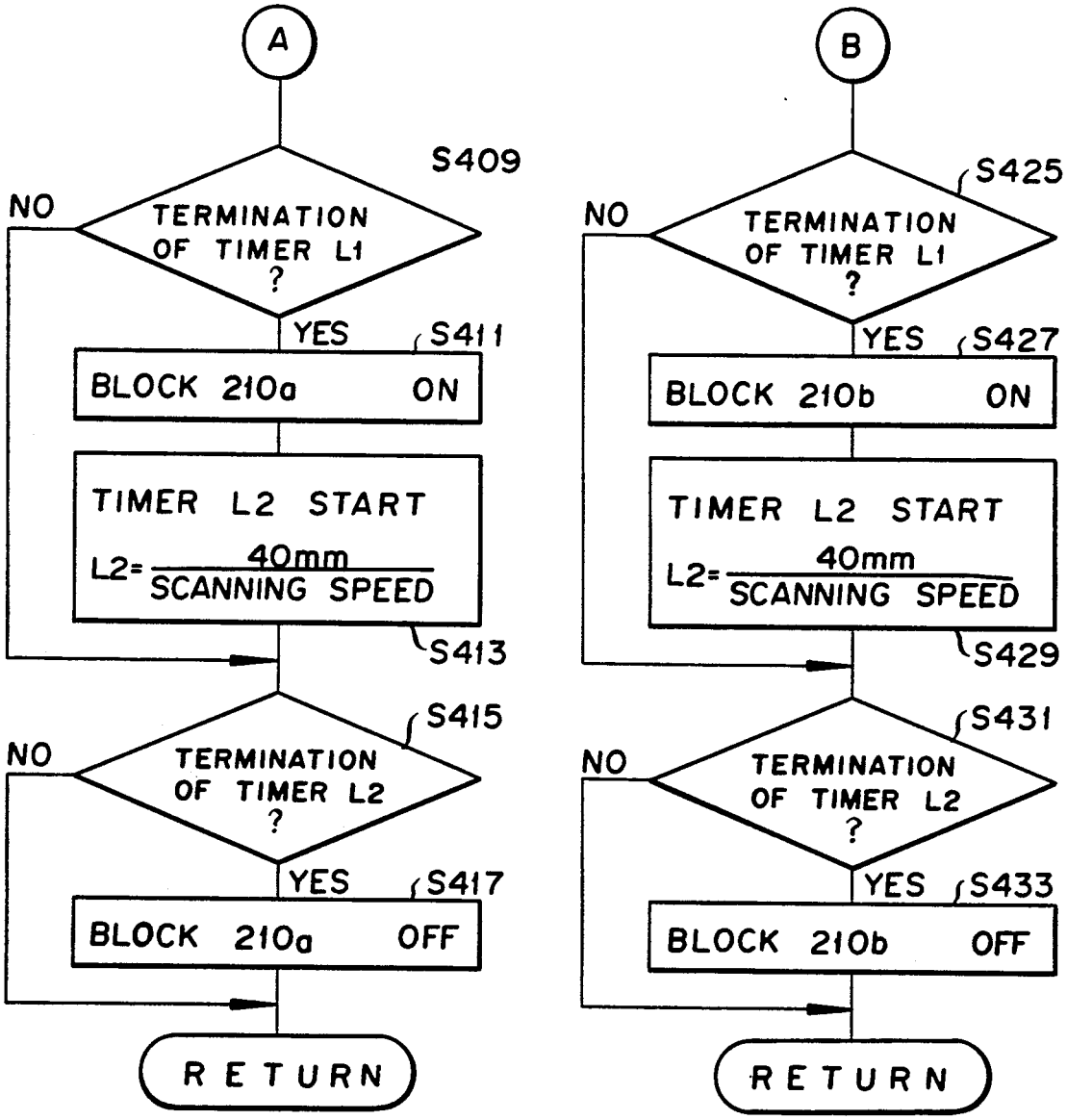

FIGS. 21A and 21B are each a flow chart illustrating the liquid crystal shutter control sub-routine of Step S9 shown in FIG. 17. The timer L1 shown in this routine is intended to control the timing for the operation of the liquid crystal shutter 210 and the timer L2 is intended to control the time in which the liquid crystal shutter 210 remains in the ON state.

When the data inscribing signal is judged to have been turned on at Step S401, the judgment as to whether or not the inscribing area has been designated is made at Step S403 by the operation of the keys marked with Nos. 1 to 12 as shown in FIG. 15. When the judgment at Step S403 draws an affirmative answer and the image end switch SW53 is judged to be in the on-edge state at Step S405, the timer L1 is started at Step S407. When the operating duration of this timer L1 is judged to have terminated at Step S409, the block **210*a* of the liquid crystal shutter 210 is turned on at Step S411 and the light path in the pertinent part is intercepted. The operating duration of the timer L1 when the area mentioned above is designated is found by the formula, (40 mm÷scanning speed)×(W−1). In the formula, the letter W denotes the number labelled on the key shown in FIG. 15, namely the coordinates number. Where the operation of the key 2001** marked by the number 1 in the diagram of FIG. 15 causes data to be inscribed in the corresponding position, for example, the coordinates value W is 1 and, since W−1=0, the block 210a of the liquid crystal shutter 201 is turned on as soon as the image end switch SW53 is turned on. When the key 2012 is operated in this case, then the coordinates value W is 12. When the liquid crystal shutter 210 is turned on, the processing of Step S413 is executed and the timer L2 is started. When the operating duration of this timer L2 is judged to have been terminated at Step S415, the block 210a of the liquid crystal shutter 210 is turned off at Step S417.

The steps from Step S403 through Step S417 are the processings which are involved when any one of the keys 2001 to 2012 marked by the numbers 1 to 12 among other keys of the editor 2000 shown in FIG. 14 is operated. When any one of the keys 2013 to 2042 marked by the numbers 13 to 24 is operated, this fact is discerned at Step S419 shown in FIG. 21A and the processings of Steps S421 to S433 are executed similarly. Even when any one of the keys in the other files is operated, the value of the timer L1 is set by the formula and the same processings are executed.

Figure 22:
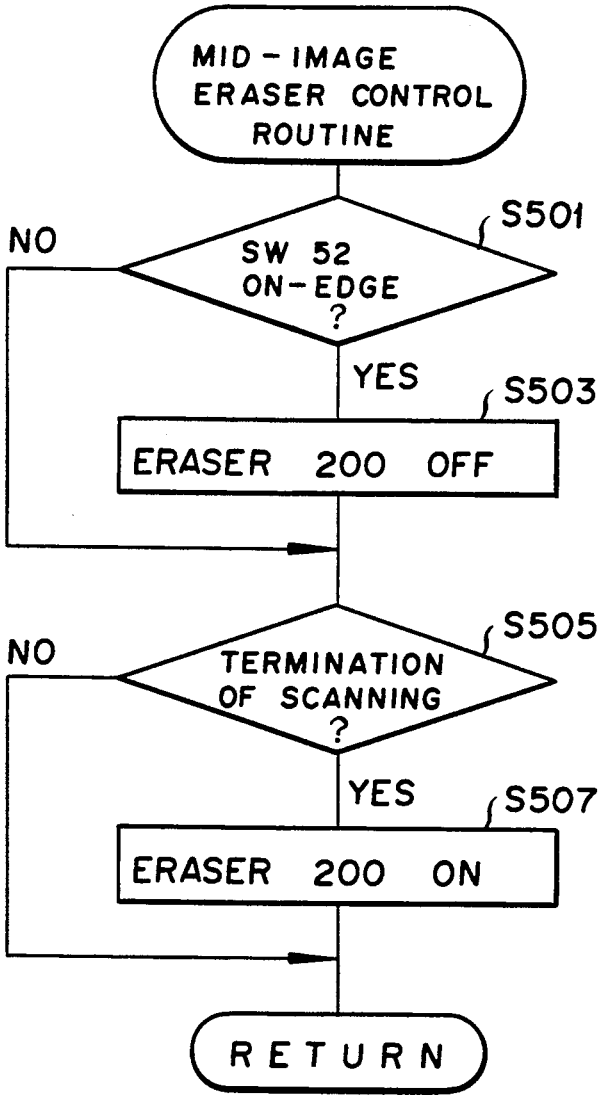
FIG. 22 is a flow chart illustrating an mid-image iraser control sub-routine.

FIG. 22 illustrates the mid-image eraser control sub-routine shown at Step S11 of FIG. 17. When the erase switch SW52 is judged to be in the on-edge state at Step S501 by the scanner of the optical system 400, the mid-image eraser 200 is turned off at Step S503. When the operating duration of the scanner is found to have terminated at Step S505, the mid-image eraser 200 is turned on at Step S507. As a result, the mid-image eraser 200 is turned off with respect to the part of the photosensitive drum 1 on which the latent image is present.

Figure 23A:
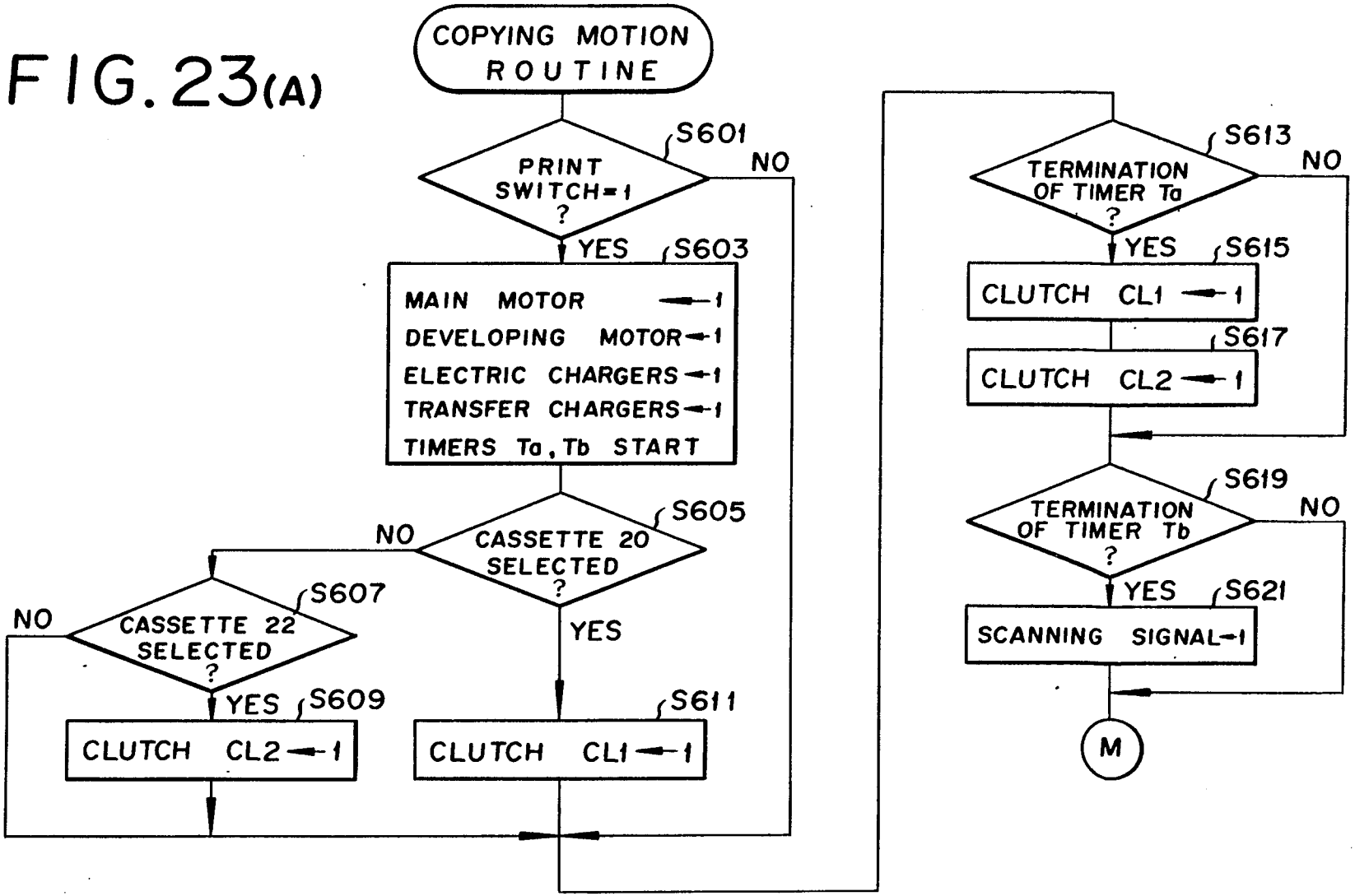
FIGS. 23A and 23B are each a flow chart illustrating a copy operation sub-routine.
Figure 23B:
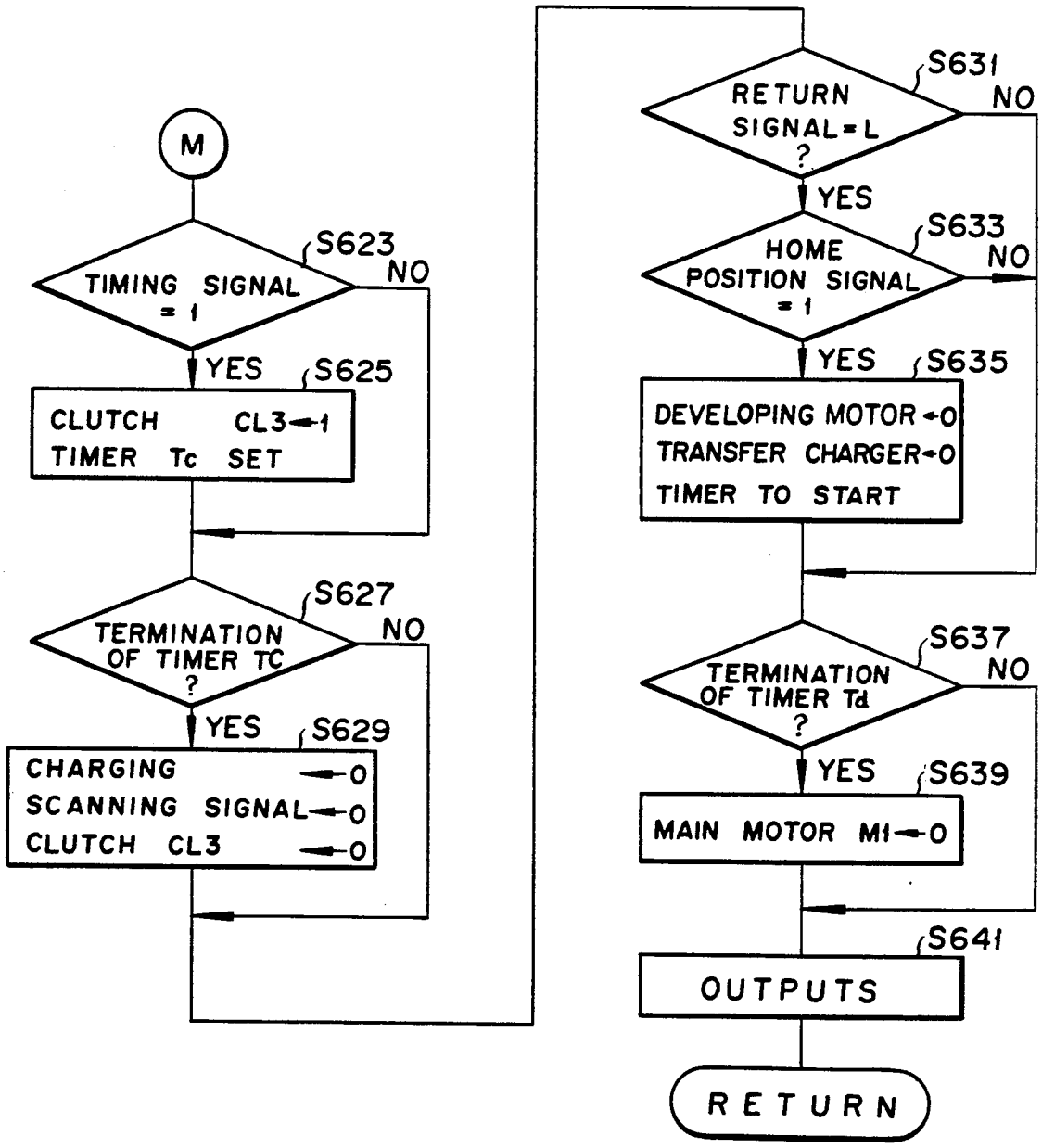

FIG. 23 is a flow chart illustrating the copying motion sub-routine shown at Step S13 of FIG. 17. When the print switch 71 shown in FIG. 7 is judged to have been pressed down at Step S601, the processing of Step S603 is executed. At this step, the main motor M1, the developing motor M2, the chargers 3 and 5, and the transfer charger 7 are severally started and the timers Ta and Tb for control are severally started. The timer Ta is intended to control the time in which the paper feeding rollers 721 and 771 are kept in operation and the timer Tb is intended to control the timing for starting the scanning operation.

When the copying paper in the paper feeding cassette 20 shown in FIG. 1 are judged to have been selected for copying at Step S605, the clutch CL1 is turned on at Step S611 so as to actuate the paper feeding roller 771. When the copying papers in the paper feeding cassette 22 are judged to have been selected for copying at Step S607, the clutch CL2 is turned on at Step S609 so as to actuate the paper feeding roller 721. When the operating duration of the timer Ta is terminated, the paper feeding clutches CL1 and CL2 are turned off at Steps S615 at S617.

When the operating duration of the timer Tb is judged to have terminated at Step S619, the processing of Step S621 is executed and the scanning operation is started. When the issue of a timing signal is detected at Step S623 during the course of this scanning operation, the timing clutch CL3 is turned on so as to drive the timing roller 73 at Step S625 and, at the same time, the processing for setting the timer Tc is executed at Step S625. This timer Tc is intended to control the time in which the timing roller 73 continues to operate. By the timing roller 73, the copying papers are conveyed as synchronized with the toner image on the photosensitive drum 1.

When the operating duration of the timer Tc is judged to have terminated at Step S627, the charging, the scan motor, and the clutch CL3 are severally turned off at Step S629. The operating duration of the timer Tc may be varied proportionately to the size of copying papers to be used.

When the issue of a return signal is detected at Step S631 and the return of the optical system to the home position is detected at Step S633, the developing motor M2 and the transfer charger 7 are severally turned off and the timer Td is set at Step S635. When the operating duration of the timer Td is judged to have terminated at Step S637, the main motor M1 is turned off at Step S639 and the processings for various outputs are executed at Step S641.

The timers Ta to Td mentioned above are digital timers which are programmed so as to increase by "1" one routine of the processing of the copying operation to be execute within the time prescribed by the internal timer. The time so increased is memorized as numerical data.

Figure 24A:
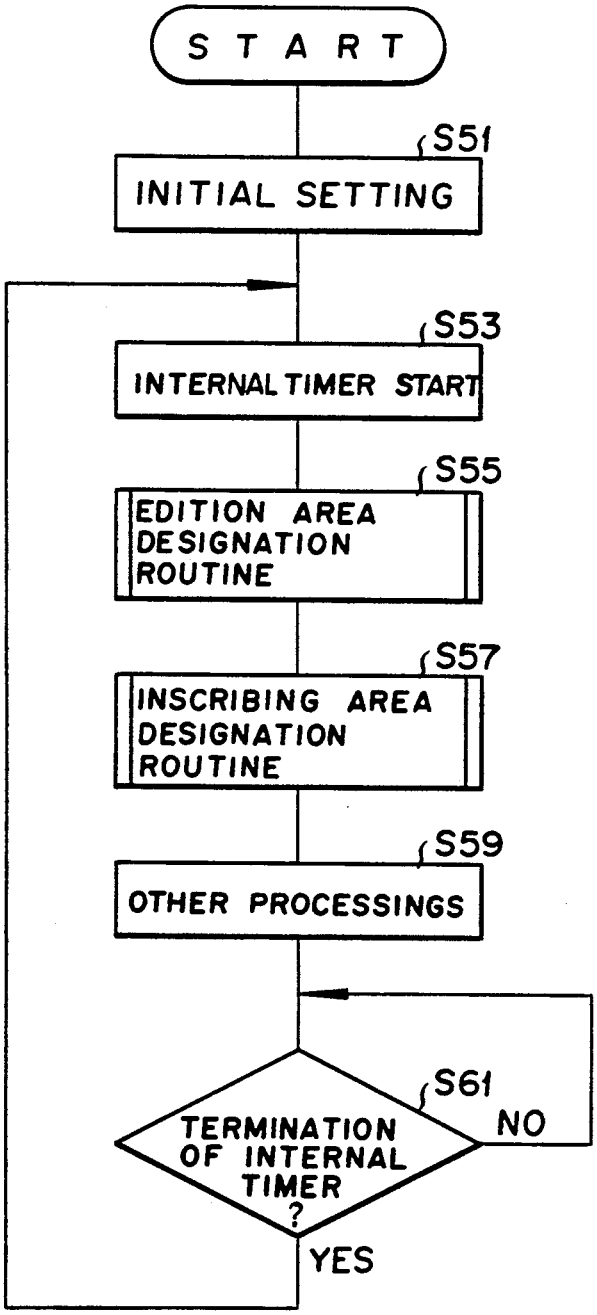
FIGS. 24A and 24B are each a main flow chart illustrating the control of an editor.

FIG. 24A illustrates a main flow chart of the operation of the third CPU 204 for the control of the editor 2000. When the second CPU 204 is reset and the program is started, the initial setting is executed at Step S51, the RAM 2151 cleared, the various registers set, and the apparatus set at the initial mode. At Step S53, the internal timer incorporated in the third CPU 204 and held in the initialized state is started. Then, the edition area designation sub-routine, the inscribing area designation sub-routine, and other processing sub-routines are sequentially called in the order mentioned at Steps S55, S57, and S59 respectively. When the sub-routine processings are wholly completed, one routine is terminated at the time that the operating duration of the initially set internal timer expires at Step S61. The various timers used in the sub-routines count time with the length of time of one routine as the unit. The operating durations of these various timers are such that their termination is judged based on the question as to how often the timers have counted this one routine.

Figure 24B:
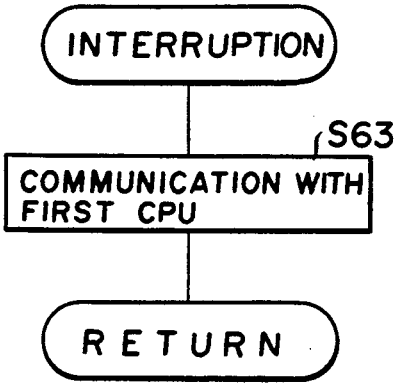

The communication between the first CPU 201 and the third CPU 204, as illustrated in FIG. 24B, is carried out by the interruption routine shown in FIG. 24B based on the demand for interruption from the first CPU201 (Step S63) without reference to the main routine.

Figure 25A:
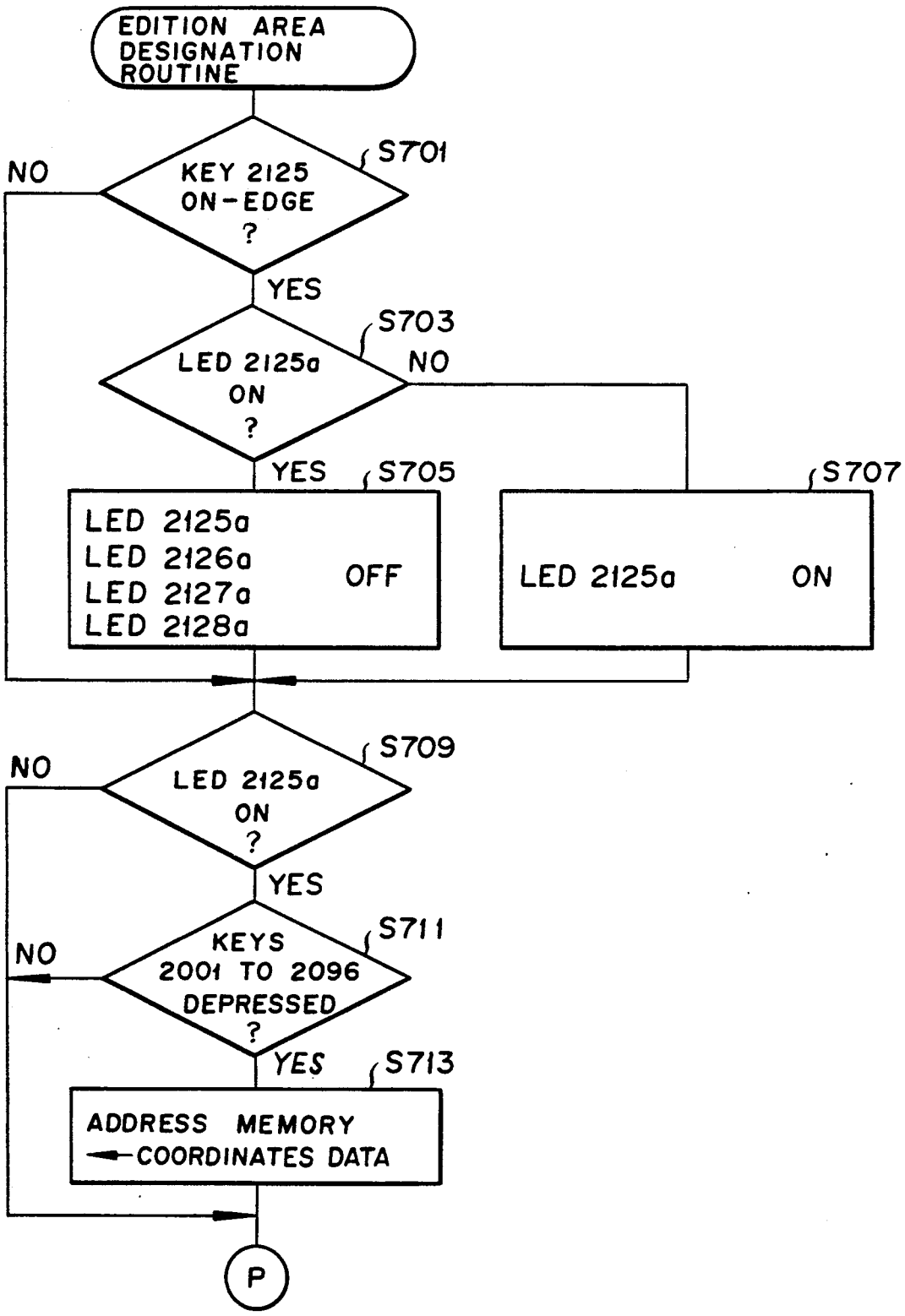
FIGS. 25A and 25B are each a flow chart illustrating an edition area designation sub-routine.
Figure 25B:
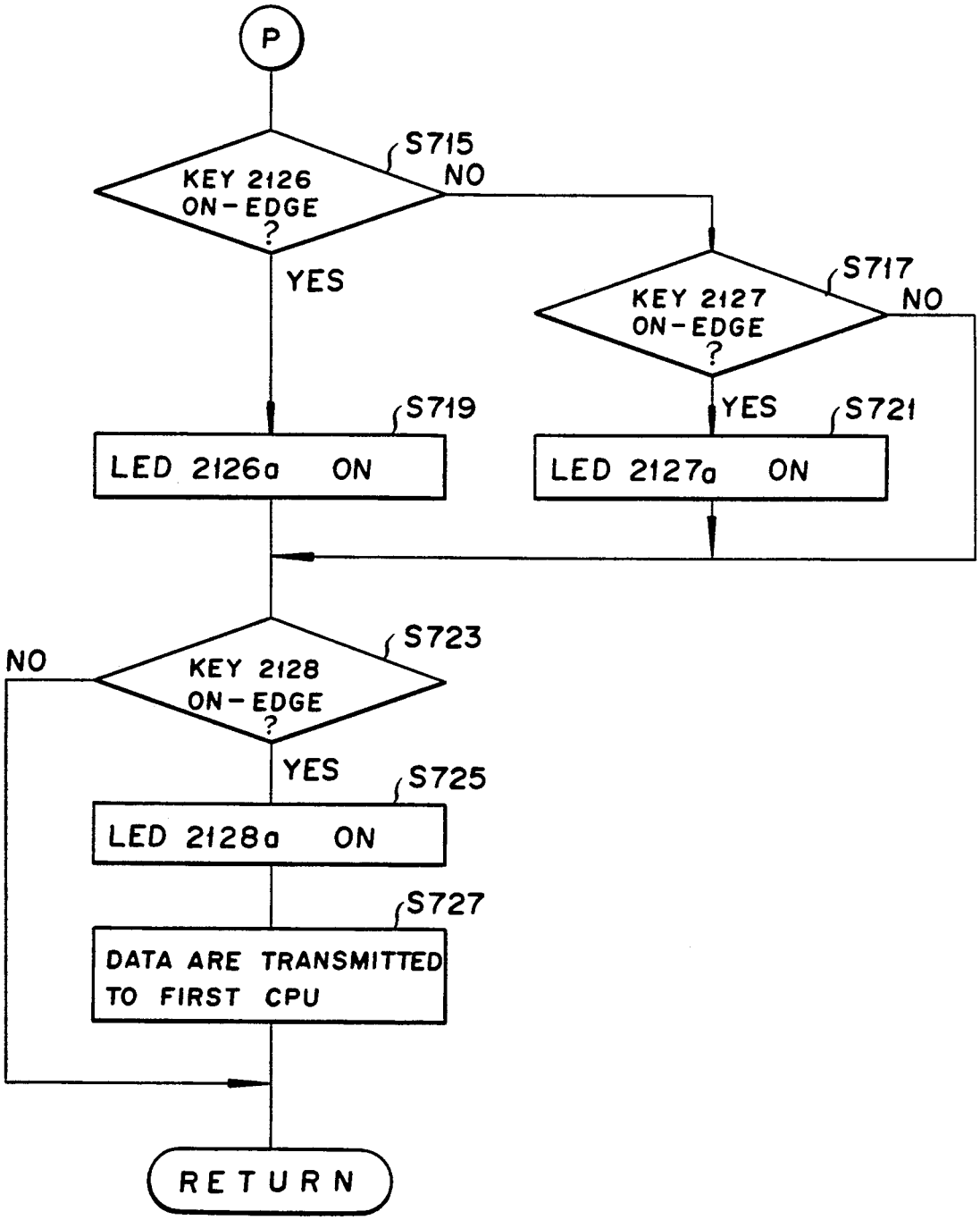

FIG. 25 is a flow chart illustrating the edition area designation routine shown at Step S55 of FIG. 24A. When the are designation key 2125 shown in FIG. 14 is judged to be in the on-edge state at Step S701, the LED's 2125a to 2128a are turned off at Step S705 where the LED 2125a has been already turned on (YES at step S703) or the LED 2125 is turned on at Step S707 where the LED 2125a has been already turned off (NO at Step S703).

The fact that the LED 2125a is judged to be in the ON state at Step S709 means that the edition mode has been set. Thus, the fact that one of the keys 2001 to 2096 marked by the symbols 1 to 96 and disposed on the editor 2000 shown in FIG. 15 has been depressed is discerned at Step S711 and the coordinates data of the depressed key is stored as data for the edition of image in the address memory at Step S713.

Then, the LED 2126a is turned on at Step S719 when the key 2126 is judged to be in the on-edge state at Step S715, and the LED 2127*a* is turned on at Step S721 when the key 2127 is judged to be in the on-edge state at Step S717. When the are set key 2128 is judged to be in the ON state at Step S723 after the inputs for the edition mode have been wholly completed, the LED 2128*a* is turned on at Step S725 and the data on image edition received up to that time (the data on coordinates and on choice between erasure or copy) are transmitted to the first CPU 201 at Step S727.

Figure 26:
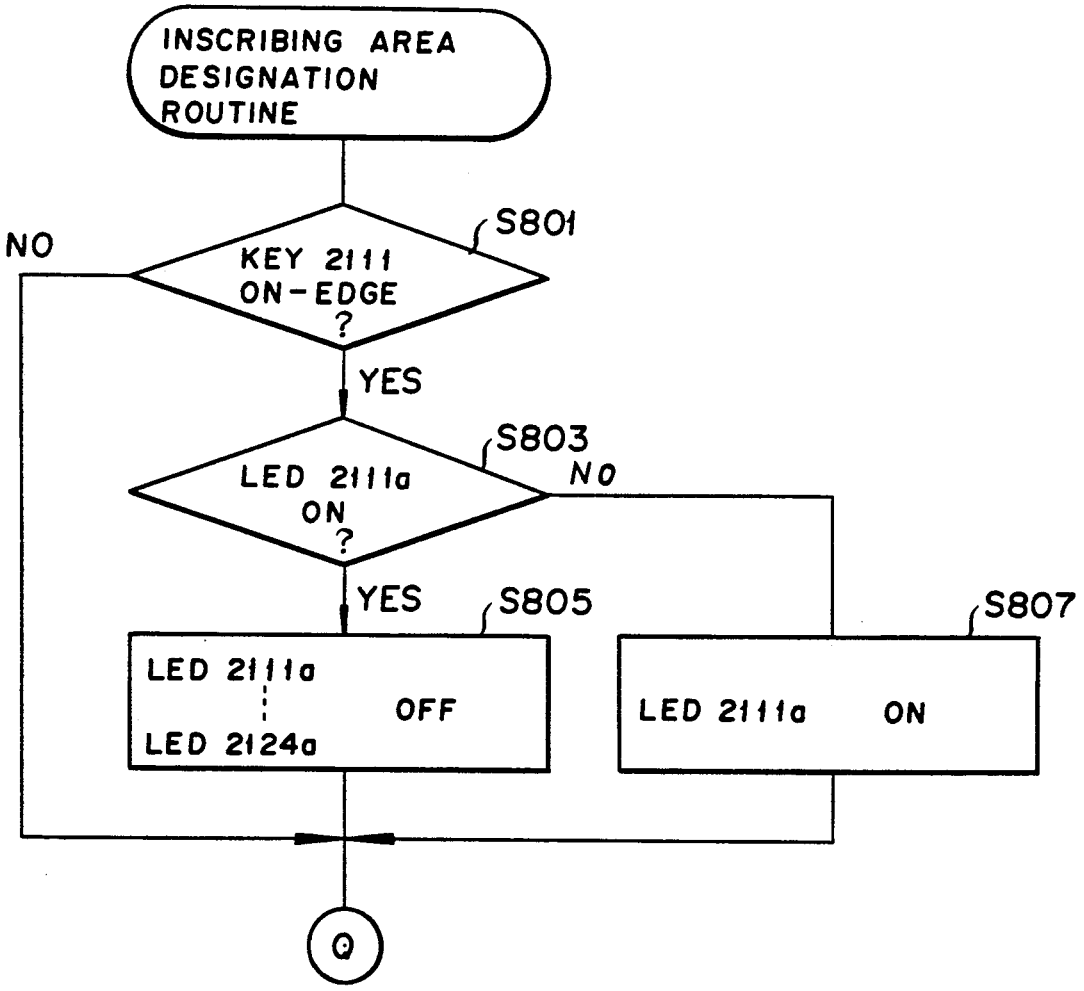
FIGS. 26A to 26D are each a flow chart illustrating an inscribing area designation sub-routine.
Figure 26B:
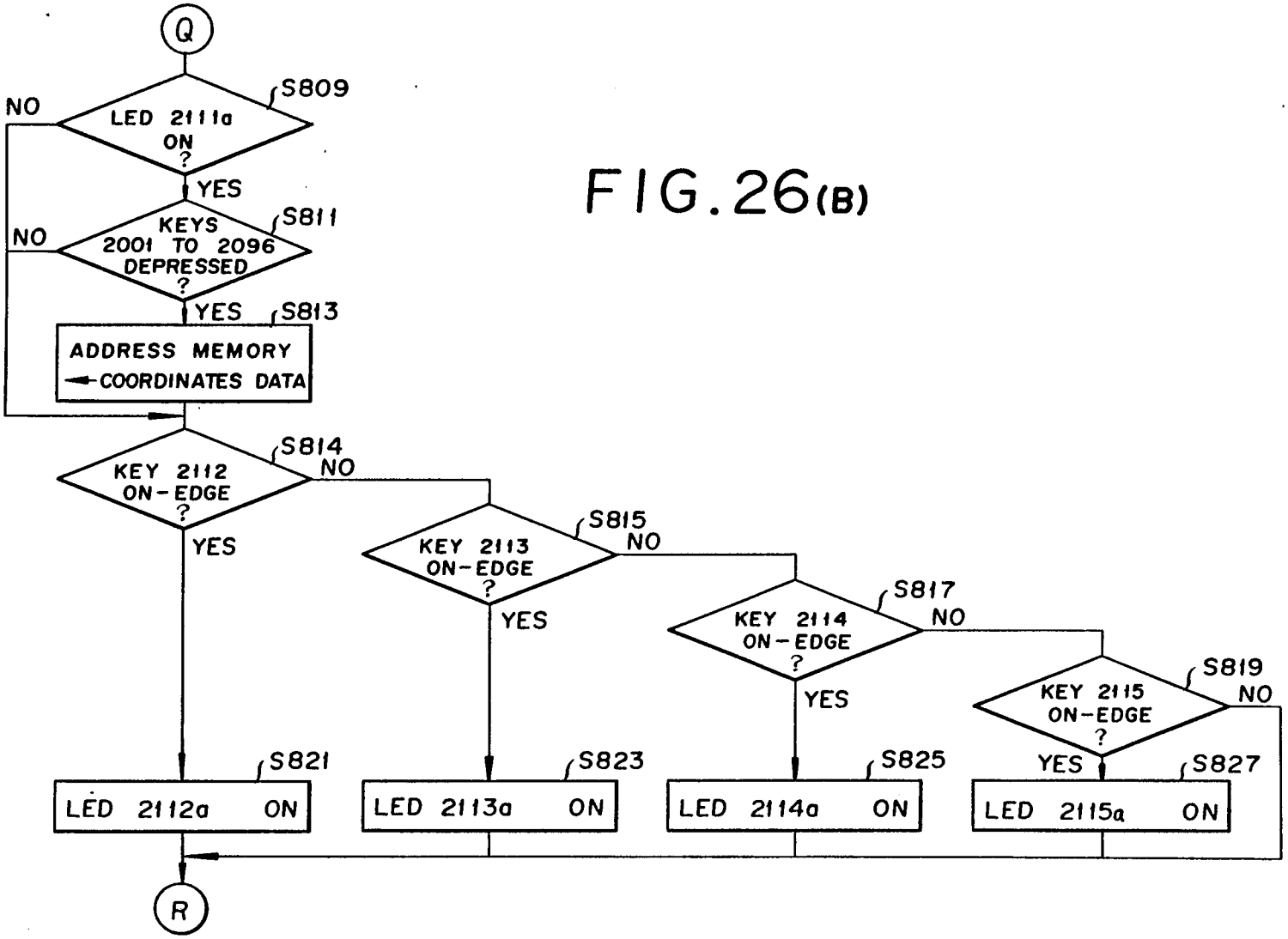

FIG. 26 is a flow chart illustrating the inscribing area designation sub-routine shown at Step S57 of FIG. 24A. When the data inscription designation key 2111 shown in FIG. 14 is judged to be in the on-edge state at Step S801, the LED's 2111*a* to 2124*a* are turned off at Step S805 where the LED 2111*a* is judged to have been already turned on at Step S803 or the LED 2111*a* is turned on at Step S807 where the LED 2111*a* is judged to have been already turned off at Step S803.

Then, when the LED 2111*a* is judged to be in the ON state at Step S809, this fact means that the apparatus is set for the mode of inputting the coordinates position of data inscription. Thus, the coordinates data is stored as the data for data inscription in the address memory at Step S813 when any one of the keys 20001 to 2096 on the panel of the editor 2000 is judged to have been depressed. When any of the keys 2112 to 2115 for designating the direction of data inscription is depressed at Step S814, S815, S817, or S819, the corresponding one of the LED's 2112*a* to 2115*a* is turned on at Step S821, S823, S825, or S827.

Figure 26C:
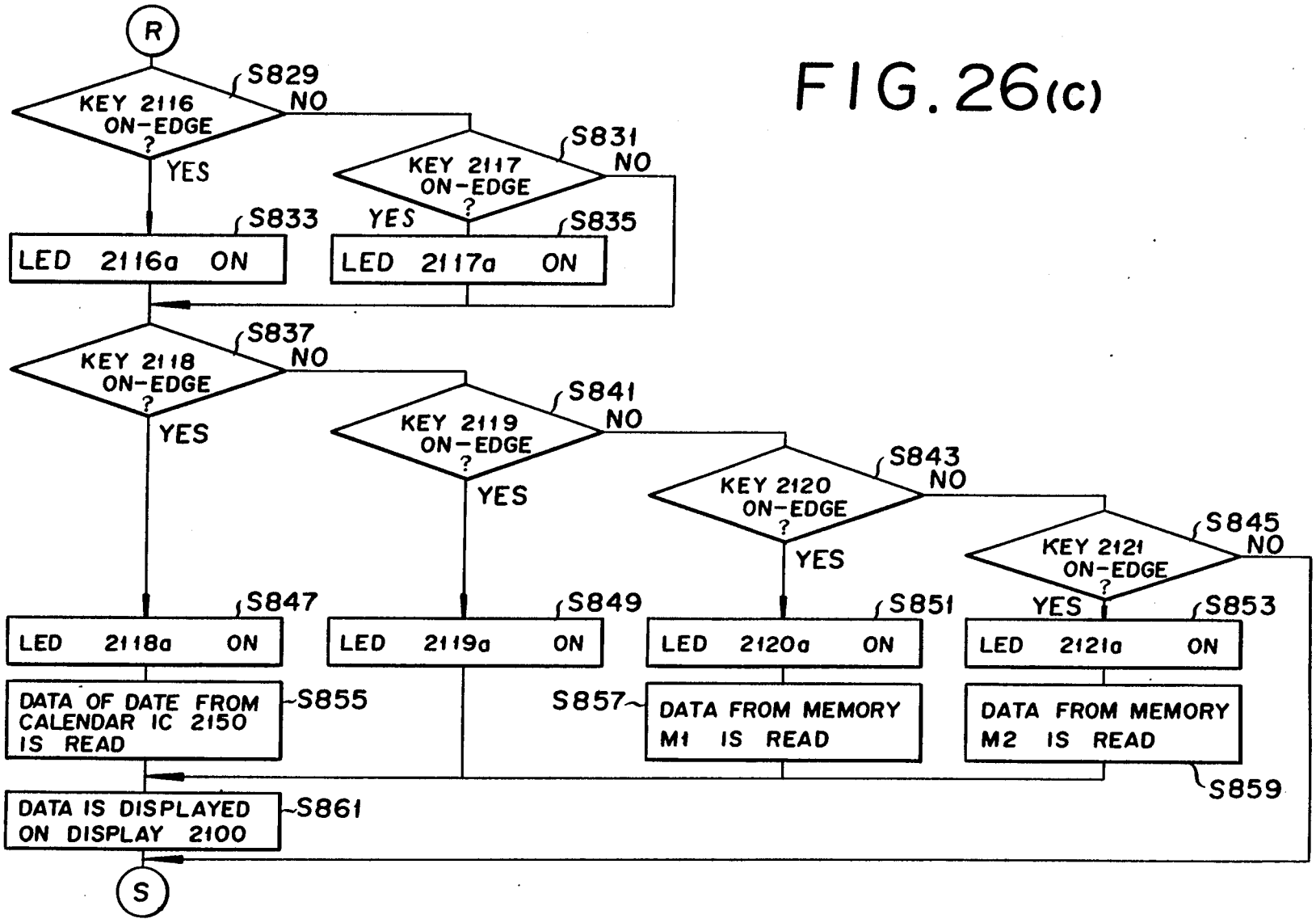
Figure 26D:
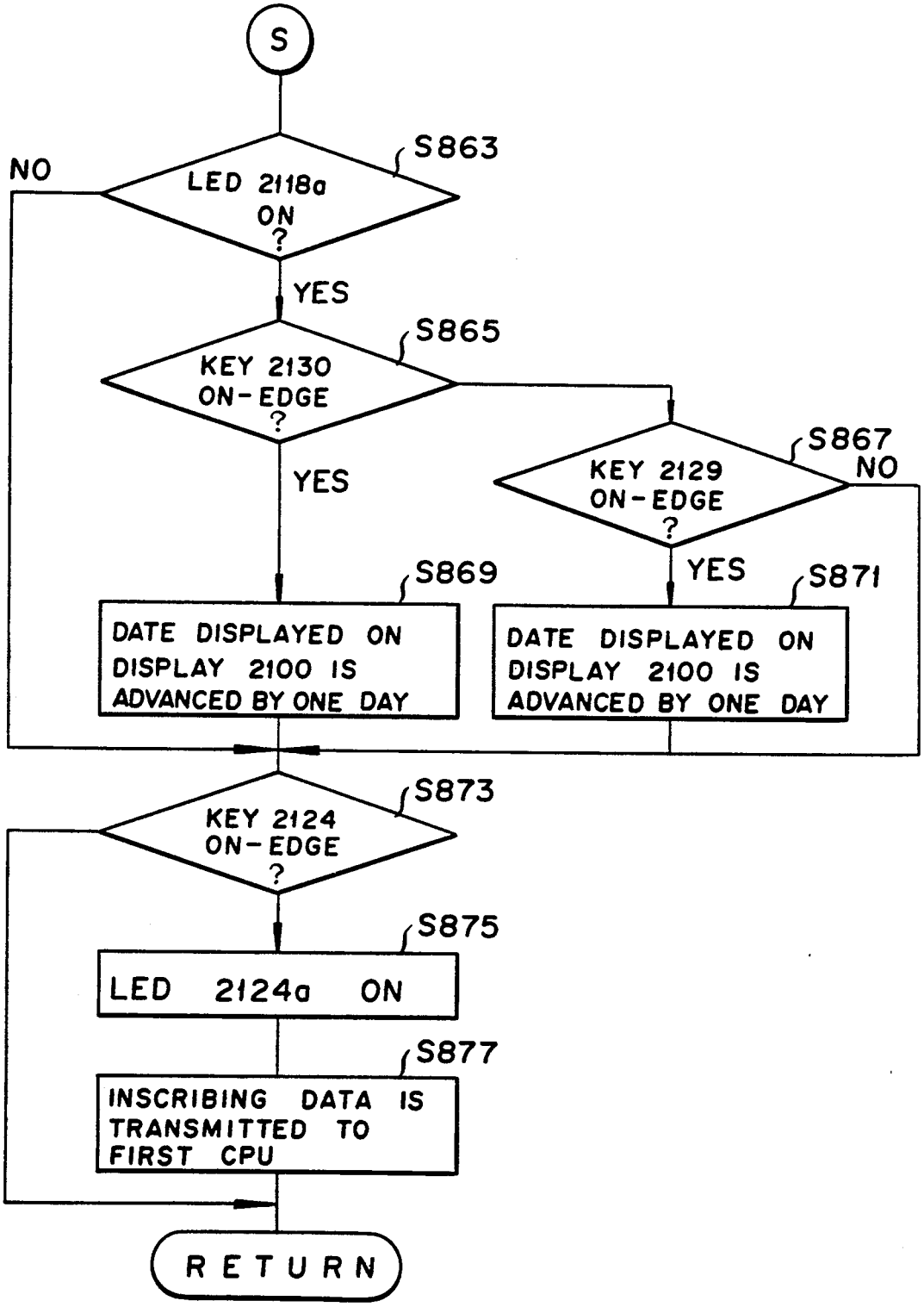

When either the key 2116 to be operated when the document is in positive print or the key 2117 to be operated when the document is in a negative print is depressed at Step, S829 or S831 as illustrated in FIG. 26C, a corresponding one of the LED's 2116*a* and 2117*a* is turned on at Step S833 or S835. Then, when any one of the select keys 2118 to 2121 is depressed for specifying the data to be inscribed (YES at Step S837, S841, S843, or S845), a corresponding one of LED's 2118*a* to 2121*a* is turned on at Step S847, S849, S851, or S853.

When the select key 2118 is depressed, the data of date from the calendar IC 2150 backed up by a battery is read at Step S855 and stored as the data for inscription in the address memory of the third CPU 204. When the other select key 2120 or 2121 is depressed, desired data memorized in advance is loaded from the memory 2151 backed up by a battery at Step S857 or S859. The data to be inscribed is displayed on the liquid crystal display part 2100 at Step S861.

When the key 2130 is detected to be in the on-edge state at Step S865 while the LED 2118*a* is kept in the ON state, namely while the date inscribing mode is in the ON state (YES at Step S863), the data of date stored in the address memory is advanced by the margin of one day and, at the same time, the date displayed on the liquid crystal display part 2100 is advanced by one day at step S869. This processing applies where data prepared for a meeting to be held on the following day is copied. When the key 2129 is detected to be in the on-edge state at Step S867, the data of date stored in the address memory is set back by one day and, at the same time, the date displayed on the liquid crystal display part 2100 is set back by one day at Step S871. This processing applies where the results of a meeting held o the previous day are to be copied. The number of days involved in advancing or setting back the date is irrelevant.

When the data inscription set switch 2124 is turned on after the input of the data for inscription is completed, the on-edge state is detected at Step S873 and the LED 2124*a* is turned on at Step S875. Then at Step S877, the data already received (data for inscription, inclusive of coordinates of position of inscription, direction of inscription, choice between negative image and positive image, and date) is transmitted to the first CPU 201. The first CPU, based on the data thus transmitted, controls the switching of the light emitting elements of the LED array 1252 of the inscribing head 1251 and controls the execution of the data inscribing operation of the data inscribing device 1250.

In the illustrated copying machine, a date different from the date on which the copying machine is actually used is inscribed on the copying paper as described above.

Though the illustrated copying machine operates on an analogous mechanism, this invention can be applied effectively to a digital copying machine or printer, for example.

In the illustrated image forming apparatus, the data in the memory for date inscription is corrected and the date consequently corrected is inscribed on the copying paper when the number of days for change of the date is fed in after the mode for date inscription has been set. For example, where the information intended for use in a meeting to be held next Monday is to be copied on Friday, the information bearing the date of the meeting can be produced three days prior to the meeting by feeding "+3" as the number of days for change. Where the information which has been changed in consequence of the meeting is to be prepared on the day following the meeting, the information bearing the date of the previous day can be produced by feeding in "−1." Since the original data of date resorts to the clock IC and, therefore, represents the real date, the date to be inscribed can be easily set by feeding in the number of days relevant to the contemplated change of date.

Even when the data to be changed is fed in incorrectly, it can be easily corrected by either increasing or decreasing the number of days involved in the inscription.

I claim:

1. An image forming apparatus, comprising:

an image carrying member, electrostatic latent image forming means for forming an electrostatic latent image corresponding to an image of a document on said image carrying member, additional information recording means for forming an electrostatic image corresponding to additional information other than said image of said document, clock means for giving data of present date, means for reading the data of present data from said clock means, storage means for storing said data of present data read by said reading means, changing means for changing the contents of said data of present data stored in said storage means, and control means for actuating said additional information recording means based on said data of date changed by said changing means.

2. An image forming apparatus according to claim 1, wherein said clock means comprises a clock IC backed up by a power source.

3. An image forming apparatus according to claim 1, wherein said additional information recording means includes a LED array composed of a plurality of light emitting elements and a control circuit for controlling the switching of each of said light emitting elements.

4. An image forming apparatus according to claim 1, further comprising display means for displaying said data of present data read from said clock means.

5. An image forming apparatus according to claim 4, wherein said display means further displays said contents of said data of present data which is changed by said changing means.

6. An image forming apparatus according to claim 1, wherein said changing means includes a key for advancing said data of present data one day and a key for setting back said data of present date one day.

7. An image forming apparatus, comprising:

a photosensitive member, first exposure means for projecting an optical image corresponding to an image of a document onto the surface of said photosensitive member, additional information generating means for generating additional information other than said image of said document, a second exposure source for forming the image of additional information generated by said additional information generating means;

a first memory for memorizing the data of present date, means for reading the data of present date from said first memory, a second memory for storing the date of present data read by said reading means, input means for receiving data of change to be used in effecting a necessary change of the data of present data stored in said second memory; and means for executing said necessary change in the data of date stored in said second memory based on said data of change received in said input means and for sending the data of data changed to said additional information generating means.

8. An image forming apparatus according to claim 7, wherein said second exposure source comprises a LED array.

9. An image forming apparatus according to claim 7, wherein said first memory is a clock IC backed up by a power source.

10. An image forming apparatus which forms an image of a document on an image carrying member, comprising:

position entry means for specifying a data writing area on a document;

data entry means for specifying data to be written;

data write means for writing entered data on an area of the image carrying member corresponding to the area specified with respect to the document while the light from the specified area of the document is cut off;

memory means for storing data for writing;

means for reading the data from said memory means and for storing the read data;

means for changing the contents of the read data without changing the data stored in said memory means; and means for sending the changed data to said data write means.

11. An image forming apparatus according to claim 10, wherein said the data stored in said memory means is the present date.

12. An image forming apparatus according to claim 10, wherein said data write means comprises a light-shading element array arranged as a shade in a light path for exposing a document image onto the image carrying member and a light-emitting device array arranged before the light-shading array relative to said image carrying member.

* * * * *

UNITED STATES PATENT AND TRADEMARK OFFICE

CERTIFICATE OF CORRECTION

PATENT NO. : 5,065,181

DATED : November 12, 1991

INVENTOR(S) : Masazumi Ito

It is certified that error appears in the above-identified patent and that said Letters Patent is hereby corrected as shown below:

Title page, item [57], line 6, "data" should read --date--.

item [57], line 11, "data" should read --date--.

In col. 2, line 41, change "date" to --data--.

In col. 2, line 62, change ":" (colon) to --;-- (semicolon).

In col. 3, line 7, change ":" (colon) to --;-- (semicolon).

In col. 3, line 13, change ":" (colon) to --;-- (semicolon).

In col. 3, line 35, change "iraser" to --eraser--.

UNITED STATES PATENT AND TRADEMARK OFFICE

CERTIFICATE OF CORRECTION

PATENT NO. : 5,065,181

DATED : November 12, 1991

INVENTOR(S) : Masazumi Ito

It is certified that error appears in the above-identified patent and that said Letters Patent is hereby corrected as shown below:

In col. 3, line 43, change ";" (semicolon) to --.-- (period).

In col. 4, line 40, change "roller" to --rollers--.

In col. 5, line 9, change "rails" to --rail--.

In col. 9, line 13, change "show" to --shown--.

In col. 12, line 21, change "execute" to --executed--.

In col. 13, line 3, change "are" to --area--.

In col. 13, line 65, change "o" to --on--.

In col. 14, line 42, change "data" to --date--.

In col. 14, line 59 (claim 1, line 12), change "data" (second occurrence) to --date--.

In col. 14, line 61 (claim 1, line 14), change "data" (second occurrence) to --date--.

In col. 14, line 64 (claim 1, line 17), change "data" (second occurrence) to --date--.

UNITED STATES PATENT AND TRADEMARK OFFICE

CERTIFICATE OF CORRECTION

PATENT NO. : 5,065,181

DATED : November 12, 1991

INVENTOR(S) : Masazumi Ito

It is certified that error appears in the above-identified patent and that said Letters Patent is hereby corrected as shown below:

In col. 15, line 11 (claim 4, line 3), change "data" (second occurrence) to --date--.

In col. 15, line 14 (claim 5, line 3), change "data" (second occurrence) to --date--.

In col. 15, line 19 (claim 6, line 3), change "data" (second occurrence) to --date--.

In col. 15, line 37 (claim 7, line 16), change "date of present data" to --data of present date--.

In col. 15, last line (claim 7, line 20), change "data" to --date--.

In col. 16, line 4 (claim 7, line 24), change "data" (second occurrence) to --date--.

Signed and Sealed this

Eleventh Day of May, 1993

*Attest:*

*Attesting Officer*

Michael K. Kirk

MICHAEL K. KIRK

*Acting Commissioner of Patents and Trademarks*